US009648670B2

(12) United States Patent
Nobue et al.

(10) Patent No.: US 9,648,670 B2
(45) Date of Patent: May 9, 2017

(54) MICROWAVE HEATING DEVICE

(75) Inventors: Tomotaka Nobue, Kyoto (JP); Yoshiharu Oomori, Shiga, PA (US); Kenji Yasui, Shiga (JP); Makoto Mihara, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 951 days.

(21) Appl. No.: 13/392,683

(22) PCT Filed: Sep. 8, 2010

(86) PCT No.: PCT/JP2010/005495
§ 371 (c)(1),
(2), (4) Date: Feb. 27, 2012

(87) PCT Pub. No.: WO2011/033740
PCT Pub. Date: Mar. 24, 2011

(65) Prior Publication Data

US 2012/0152939 A1 Jun. 21, 2012

(30) Foreign Application Priority Data

Sep. 16, 2009 (JP) ..... 2009-213955

(51) Int. Cl.
*H05B 6/64* (2006.01)
*H05B 6/68* (2006.01)
(Continued)

(52) U.S. Cl.
CPC ..... *H05B 6/686* (2013.01); *H05B 6/705* (2013.01); *H05B 6/72* (2013.01)

(58) Field of Classification Search
CPC ..... H05B 6/686; H05B 6/72
(Continued)

(56) References Cited

U.S. PATENT DOCUMENTS 4,720,688 A * 1/1988 Hasegawa et al. ..... 331/2
5,057,660 A 10/1991 Yamada et al.
(Continued)

FOREIGN PATENT DOCUMENTS

CN 1430020 A 7/2003
CN 101502170 A 8/2009
(Continued)

OTHER PUBLICATIONS

Search Report from Chinese Application No. 201080040058.9, dated Sep. 8, 2010, 4 pages.
(Continued)

*Primary Examiner* — Quang Van
(74) *Attorney, Agent, or Firm* — Brinks Gilson & Lione

(57) ABSTRACT

A microwave heating device according to the present invention includes a microwave oscillation portion including a reference-signal oscillator formed from a quarts oscillator, phase variable portions and phase-locked loops and, further, includes a control portion for controlling the microwave oscillation portion, and plural radiation portions placed on a wall surface of a heating chamber for housing a to-be-heated object, wherein microwaves supplied to plural microwave feeding points provided in the radiation portions are controlled in phase and electric power, thereby controlling the aspect of radiations of microwaves radiated from the radiation portions.

10 Claims, 14 Drawing Sheets

(51) Int. Cl.
*H05B 6/70* (2006.01)
*H05B 6/72* (2006.01)

(58) Field of Classification Search
USPC ..... 219/600, 660, 690, 702, 746, 749, 761; 315/39.51, 39.53, 39.3, 500; 343/700 MS, 756
See application file for complete search history.

(56) References Cited

U.S. PATENT DOCUMENTS

| | | | | |
|---|---|---|---|---|
| 5,237,139 | A | 8/1993 | Berg et al. | |
| 5,558,800 | A | 9/1996 | Page | |
| 5,981,928 | A * | 11/1999 | Lee | H05B 6/70 219/749 |
| 6,884,979 | B1 | 4/2005 | Torngren et al. | |
| 7,435,931 | B1 | 10/2008 | McKee et al. | |
| 7,445,690 | B2 | 11/2008 | Kasai et al. | |
| 2002/0023922 | A1 | 2/2002 | Lee et al. | |
| 2003/0121913 | A1 | 7/2003 | Hayami et al. | |
| 2005/0088246 | A1 | 4/2005 | Wood | |
| 2005/0162335 | A1 | 7/2005 | Ishii | |
| 2006/0021980 | A1 | 2/2006 | Lee et al. | |
| 2006/0289526 | A1 | 12/2006 | Takizaki et al. | |
| 2007/0215608 | A1 | 9/2007 | Yoshino | |
| 2009/0038369 | A1 | 2/2009 | Vondras | |
| 2010/0176121 | A1 | 7/2010 | Nobue et al. | |
| 2010/0176123 | A1* | 7/2010 | Mihara et al. | 219/746 |
| 2010/0224623 | A1 | 9/2010 | Yasui et al. | |

FOREIGN PATENT DOCUMENTS

| | | | |
|---|---|---|---|
| EP | 2 326 142 | A1 | 5/2011 |
| JP | 53-005445 | A | 1/1978 |
| JP | 56-132793 | A | 10/1981 |
| JP | 60-193292 | A | 10/1985 |
| JP | 4-233188 | A | 8/1992 |
| JP | H 07-122357 | A | 5/1995 |
| JP | H 07-142165 | A | 6/1995 |
| JP | H 08-171986 | A | 7/1996 |
| JP | 8-337887 | A | 12/1996 |
| JP | 2000-357583 | A | 12/2000 |
| JP | 2002-061847 | A | 2/2002 |
| JP | 2003-249345 | A | 9/2003 |
| JP | 2003-308962 | A | 10/2003 |
| JP | 2008-066292 | | 3/2008 |
| JP | 2008-146966 | | 6/2008 |
| JP | 2008-146967 | A | 6/2008 |
| JP | 2008146967 | A * | 6/2008 |
| JP | 2008-269794 | A | 11/2008 |
| JP | 2009-170335 | A | 7/2009 |
| JP | 2009-187856 | A | 8/2009 |
| JP | 2009-230881 | A | 10/2009 |
| WO | WO 03/077299 | A1 | 9/2003 |
| WO | WO 2009/050893 | A1 | 9/2010 |

OTHER PUBLICATIONS

International Search Report for International Application No. PCT/JP2010/005495, dated Dec. 14, 2010, 2 pages.
International Preliminary Examination Report for International Application No. PCT/JP2010/005495, dated Dec. 21, 2011, 11 pages.
International Preliminary Report on Patentability for International Application No. PCT/JP2010/005495, dated Apr. 4, 2012, 4 pages.
Extended European Search Report for European Application No. 10816855.0, dated Jul. 24, 2012, 4 pages.
Extended European Search Report in corresponding European Application No. 10813522.9, dated Apr. 23, 2014, 5 pages.
International Search Report for International Application No. PCT/JP2010/005431, dated Dec. 14, 2010, 4 pages.
Office Action issued in Japanese application serial No. 2011-529822 on Jul. 15, 2014, 5 pages.
Office Action issued in U.S. Appl. No. 13/393,955 dated Aug. 7, 2014, 11 pages.
Office Action issued in U.S. Appl. No. 13/393,955 dated Mar. 11, 2015, 11 pages.
Office Action issued in U.S. Appl. No. 13/393,955 dated Oct. 6, 2015, 11 pages.
Translation of the International Preliminary Report on Patentability for International Application No. PCT/JP2010/005431, dated Apr. 11, 2012, 11 pages.

* cited by examiner

MICROWAVE HEATING DEVICE

This application is a 371 application of PCT/JP2010/005495 having an international filing date of Sep. 8, 2010, which claims priority to JP 2009-213955 filed Sep. 16, 2009, the entire contents of which are incorporated herein by reference.

TECHNICAL FIELD

The present invention relates to microwave heating devices including plural radiation portions for radiating microwaves generated from microwave generating means.

BACKGROUND ART

Conventional microwave heating devices of this type have been structured to include a heating chamber having a rectangular parallelepiped shape, in general, wherein the heating chamber includes one or more radiation portions. Such plural radiation portions have been structured such that the radiation portions are provided on an upper wall surface and a bottom wall surface of the heating chamber and, also, the respective radiation portions are supplied with microwaves from dedicated microwave generating means. In other cases, such plural radiation portions have been structured such that two radiation portions are provided on side wall surfaces of the heating chamber and, also, the two radiation portions are supplied with microwaves from a single microwave generating means through a waveguide (refer to Patent Literature 1, for example).

Further, in some structures, plural radiation portions are dispersively placed on wall surfaces of a heating chamber, and microwave generating means are provided for supplying microwaves to the respective radiation portions, wherein, out of these microwave generating means, the microwave generating means placed on at least two wall surfaces are operated in a time-division manner (refer to Patent Literature 2, for example).

As described above, with the microwave heating device disclosed in Patent Literature 2, the selected microwave generating means are operated in a time-division manner, in order to prevent the microwave generating means connected to the radiation portions from being broken by microwaves received by these radiation portions due to interference of microwaves within the space in the heating chamber, which enables operating the plural microwave generating means substantially at the same time.

Further, by properly selecting connections between the heating chamber and the microwave generating means, for the radiation portions placed on the wall surfaces orthogonal to each other in the heating chamber, it is possible to suppress interference of microwaves radiated from both the radiation portions, thereby enabling oscillating the microwave generating means at the same time.

Some conventional microwave heating devices have been structured to include plural radiation portions and have been adapted to change the amounts of microwave electric power supplied to the respective radiation portions, through control of a phase shifter provided in a microwave generating means (refer to Patent Literature 3, for example).

In such a conventional microwave heating device, the microwave generating means includes an oscillation portion constituted by a semiconductor device, a dividing portion for dividing the output of the oscillation portion into plural parts, plural amplification portions for amplifying the respective outputs resulted from the division, a synthesis portion for synthesizing the outputs from the amplification portions, and a phase shifter provided between the dividing portion and the amplification portions. In such conventional microwave heating devices, the respective radiation portions for radiating microwaves within the heating chamber are connected to two outputs of the synthesis portion.

The phase shifter is structured to change over the microwave path line length by utilizing ON/OFF characteristics of diodes. Further, the synthesis portion is constituted by a 90-degree hybrid coupler or 180-degree hybrid coupler. By controlling the phase shifter, the electric power ratio between the two outputs from the synthesis portion is changed, or the phases of the two outputs are changed to be the same phase or opposite phases.

Further, some conventional microwave heating devices have been structured to radiate circularly polarized waves from radiation portions, in order to facilitate uniformization of heating of objects to be heated within a heating chamber (refer to Patent Literature 4, for example). Patent Literature 4 discloses a microwave heating device including a heating chamber which is provided, in a wall surface thereof, with a pair of opening portions orthogonal to each other, in order to enable radiations of circularly polarized waves.

CITATION LIST

Patent Literatures

Patent Literature 1: Japanese Unexamined Patent Publication No. 04-233188

Patent Literature 2: Japanese Unexamined Patent Publication No. 53-5445

Patent Literature 3: Japanese Unexamined Patent Publication No. 56-132793

Patent Literature 4: Japanese Unexamined Patent Publication No. 2002-061847

SUMMARY OF THE INVENTION

Technical Problem

The aforementioned conventional microwave heating devices have been structured to include one or more radiation portions placed therein, wherein the radiation portions are specialized for a radiating function. Further, the aforementioned conventional microwave heating devices have been structured to radiate microwaves, such that the radiated microwaves are polarized into linearly polarized waves or circularly polarized waves.

The present invention was made in order to overcome problems in the aforementioned conventional microwave heating devices and aims at providing a microwave heating device which includes radiation portions for radiating microwaves such that the radiation portions have a function of radiating microwaves forming both linearly polarized waves and circularly polarized waves and, further, additionally have a function of synthesizing electric power and, therefore, have new radiation functions, and which is capable of optimally controlling microwave signals supplied to the radiation portions.

Solution to Problem

A microwave heating device in a first aspect of the present invention includes a microwave oscillation portion including plural phase-locked loops connected to a single reference-signal oscillator and having plural outputs; plural amplification portions for amplifying the respective outputs from the microwave oscillation portion; plural radiation portions which are adapted to be supplied with outputs from the amplification portions and to radiate microwaves to a heating chamber; and a control portion for controlling the microwave oscillation portion; wherein each of the radiation portions has plural microwave feeding points, and the respective outputs from the amplification portions are supplied to the respective microwave feeding points. With the microwave heating device having the aforementioned structure in the first aspect of the present invention, it is possible to radiate microwaves with a same frequency supplied to the respective microwave feeding points to the inside of the heating chamber, in such a way as to synthesize the electric power of these microwaves. Further, with the microwave heating device in the first aspect, it is possible to supply larger electric power to the inside of the heating chamber, without increasing the number of radiation portions, using the plural amplification portions capable of outputting relatively-smaller amounts of electric power.

In a second aspect of the present invention, in the microwave heating device in the first aspect, particularly, the microwave oscillation portion may include a phase variable portion (12*a* to 12*d*) for changing, in phase, an oscillating signal outputted from the reference-signal oscillator, whereby microwaves supplied to the plural microwave feeding points in each of the radiation portions may be set to have phases having a predetermined phase difference therebetween. With the microwave heating device having the aforementioned structure in the second aspect of the present invention, it is possible to change the aspect of radiations of microwaves resulted from the synthesis of the microwave signals having the phase difference at the microwave feeding points, thereby facilitating heating of the to-be-heated object in desired states.

In a third aspect of the present invention, in the microwave heating device in the first aspect, particularly, the microwave oscillation portion may include a phase variable portion for changing, in phase, an oscillating signal outputted from the reference-signal oscillator, whereby microwaves radiated from at least two radiation portions, out of the radiation portions, may be made variable in phase difference therebetween. With the microwave heating device having the aforementioned structure in the third aspect of the present invention, it is possible to change the positions at which the microwaves radiated from the respective radiation portions come into collision with each other, in the space within the heating chamber, which enables dispersing the distribution of microwaves within the heating chamber, thereby further facilitating uniformization of heating of the to-be-heated object.

In a fourth aspect of the invention, in the microwave heating device in the first or second aspects, particularly, the at least two microwave feeding points in each of the radiation portions may be adapted such that lines connecting the respective microwave feeding points to a center point of this radiation portion form an intersection angle of 90 degrees, and microwaves fed to the respective microwave feeding points may be made to have a phase difference of 90 degrees, therebetween, at a center frequency within a used microwave frequency range. With the microwave heating device having the aforementioned structure in the fourth aspect of the present invention, it is possible to synthesize, in electric power, the microwaves supplied to the microwave feeding points in the respective radiation portions and, further, it is possible to radiate circularly polarized waves from the radiation portions. Further, with the microwave heating device in the fourth aspect, it is possible to disperse microwaves over the entire heating chamber, thereby enabling effectively heating the to-be-heated object.

In a fifth aspect of the invention, in the microwave heating device in the first or second aspect, particularly, the at least two microwave feeding points in each of the radiation portions are adapted such that lines connecting the respective microwave feeding points to a center point of this radiation portion form an intersection angle of 90 degrees, and at a center frequency within a used microwave frequency range, with respect to the phase of microwaves fed to one of the microwave feeding points, which is defined as a reference, the phase of microwaves fed to the other microwave feeding point is changed over between 90 degrees and −90 degrees. With the microwave heating device having the aforementioned structure in the fifth aspect of the present invention, it is possible to select, through changeovers, the direction of circling, in radiating circularly polarized waves. Further, with the microwave heating device in the fifth aspect of the present invention, it is possible to change the direction of circling, according to the type and the volume of the to-be-heated object and the state of progress of heating, thereby facilitating uniformization of heating of the to-be-heated object.

In a sixth aspect of the invention, in the microwave heating device in the first or second aspect, particularly, the at least two microwave feeding points in each of the radiation portions are placed such that a line connecting the respective microwave feeding points in this radiation portion to each other passes through a center point of this radiation portion, and microwaves fed to the at least two microwave feeding points are made to have a phase difference of 180 degrees, therebetween, at a center frequency within a used microwave frequency range. With the microwave heating device having the aforementioned structure in the sixth aspect of the present invention, it is possible to radiate vertically polarized waves from the radiation portions. Further, with the microwave heating device in the sixth aspect, it is possible to radiate two microwave electric powers supplied to the microwave feeding points in the radiation portions, in such a way as to synthesize the electric powers.

In a seventh aspect of the present invention, in the microwave heating device in the first aspect, particularly, the control portion may have a function of controlling the outputs of the microwave oscillation portion and may be adapted to perform control for stopping feeding of microwaves to at least a single microwave feeding point out of the plural microwave feeding points in each of the radiation portions. With the microwave heating device having the aforementioned structure in the seventh aspect of the present invention, it is possible to radiate any of circularly polarized waves and vertically polarized waves, thereby heating the to-be-heated object in desired states. For example, in a single radiation portion, by placing lines connecting the center point of the radiation portion to the respective microwave feeding points to each other in such a way as to form an intersection angle of 90 degrees, therebetween, and by supplying microwave electric powers with a phase difference of 90 degrees therebetween to the respective microwave feeding points, it is possible to radiate circularly polarized waves. Further, by stopping the supply of microwaves to any one of the microwave feeding points, it is possible to radiate vertically polarized waves.

In an eighth aspect of the present invention, in the microwave heating device in the first aspect, particularly, the plural radiation portions may be placed on the same wall surface of the heating chamber, and the radiation portions and the microwave feeding points in the radiation portions may be placed symmetrically with respect to a line passing through an approximate center of the wall surface. With the microwave heating device having the aforementioned structure in the eighth aspect of the present invention, it is possible to concentrate the radiation portions on a single wall surface, which makes it easier to place a member for covering the radiation portions for protecting these radiation portions and, furthermore, enables controlling microwave signals supplied to the microwave feeding points in the respective radiation portions and the phases of these microwave signals, in association with one another.

In a ninth aspect of the present invention, in the microwave heating device in the first aspect, particularly, the plural radiation portions may be placed on opposing wall surfaces of the heating chamber, and the radiation portions and the microwave feeding points in the radiation portions may be placed oppositely from each other. With the microwave heating device having the aforementioned structure in the ninth aspect of the present invention, it is possible to certainly cause microwaves radiated from the respective radiation portions to come into collision with each other in the space, thereby making it possible to certainly change the microwave distribution by changing the phase difference between the radiation portions.

In a tenth aspect of the invention, in the microwave heating device in the eighth or ninth aspect, particularly, the plural radiation portions are placed in the heating chamber, such that directions of excitations of the respective radiation portions are coincident with a widthwise direction and a depthwise direction of the heating chamber. With the microwave heating device having the aforementioned structure in the tenth aspect of the present invention, it is possible to define the directions of excitations of the radiation portions in the directions toward wall surfaces of the heating chamber for clarifying the directions of propagations of microwaves within the heating chamber. As a result thereof, with the microwave heating device in the tenth aspect, it is possible to perform phase control among the respective microwave feeding points or among the radiation portions, according to the progress of preferable heating of the to-be-heated object.

In an eleventh aspect of the invention, in the microwave heating device in the eighth or ninth aspect, particularly, the plural radiation portions are placed in the heating chamber, such that directions of excitations of the respective radiation portions are coincident with a widthwise direction and a depthwise direction of the heating chamber, and microwaves fed to the respective plural microwave feeding points in each of the radiation portions are varied, in level, according to the ratio between a widthwise size and a depthwise size of the heating chamber. With the microwave heating device having the aforementioned structure in the eleventh aspect of the present invention, it is possible to facilitate dispersion of microwaves within the heating chamber according to the shape of the heating chamber. For example, in cases where the heating chamber has a larger width, by supplying larger microwave electric power to the microwave feeding points associated with the excitations in the widthwise direction, it is possible to radiate circularly polarized waves having an elliptical circling shape with a larger size in the widthwise direction of the heating chamber, thereby facilitating dispersion of radio waves within the heating chamber.

Advantageous Effects of Invention

With the microwave heating device according to the present invention, it is possible to provide a microwave heating device having a function of controlling the phases and the electric power of microwaves supplied to the respective microwave feeding points in the radiation portions to radiate microwaves forming both linearly polarized waves and circularly polarized waves and, further, having an additional function of synthesizing electric power, thereby facilitating heating of objects to be heated.

DETAILED DESCRIPTION OF THE PREFERRED EMBODIMENTS

Hereinafter, with reference to the accompanying drawings, there will be described microwave ovens, as embodiments of a microwave heating device according to the present invention. Further, the microwave heating device according to the present invention is not limited to the structures of the microwave ovens which will be described in the following embodiments and is intended to include microwave heating devices structured based on technical concepts equivalent to the technical concepts which will be described in the following embodiments and based on technical common senses in the present technical field.

First Embodiment

Figure 1:
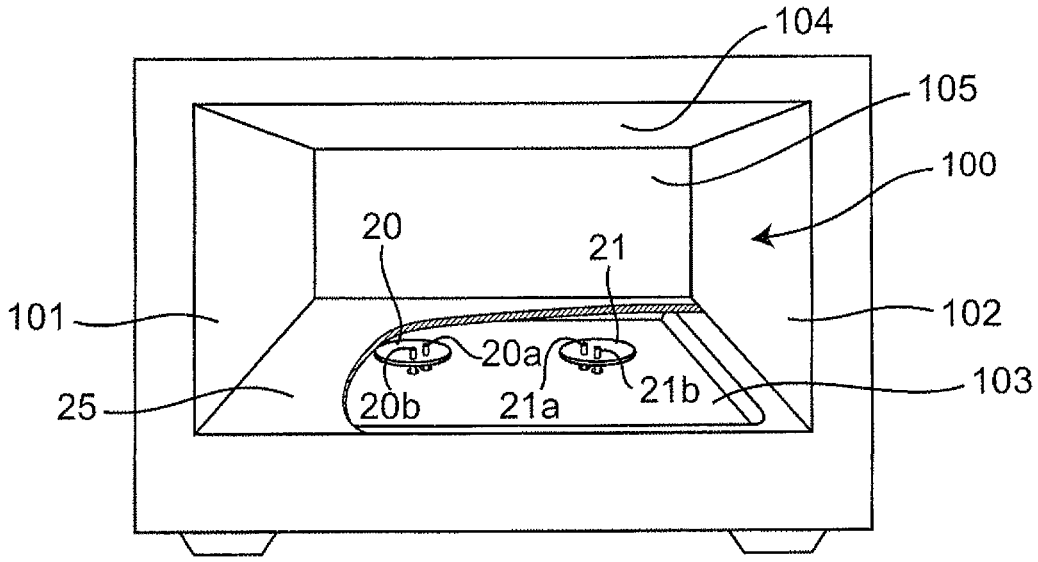
FIG. 1 is a perspective view illustrating the inside of a heating chamber in a microwave oven as a microwave heating device according to a first embodiment of the present invention.
Figure 2:
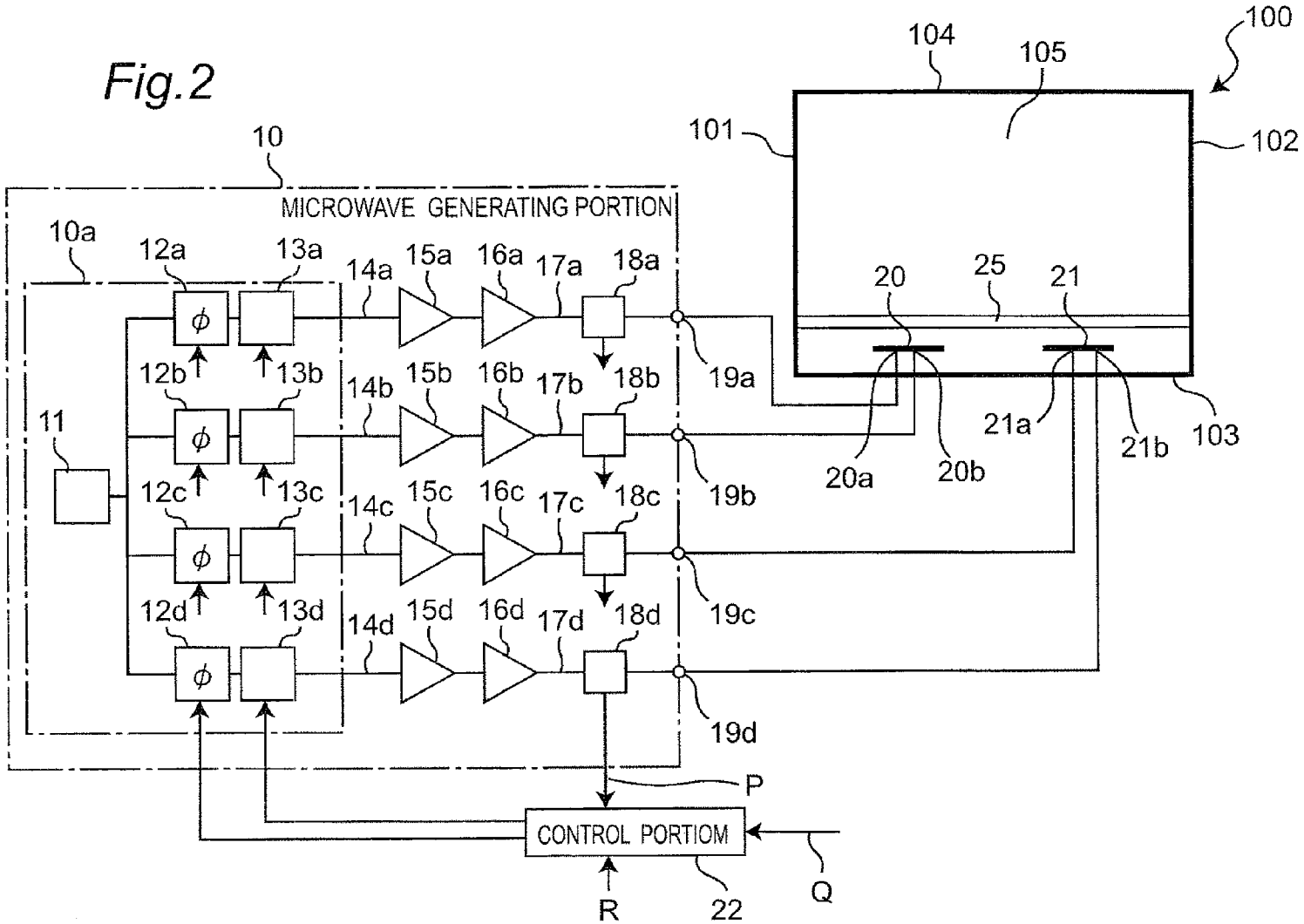
FIG. 2 is a block diagram illustrating the structure of the microwave heating device according to the first embodiment.
Figure 3:
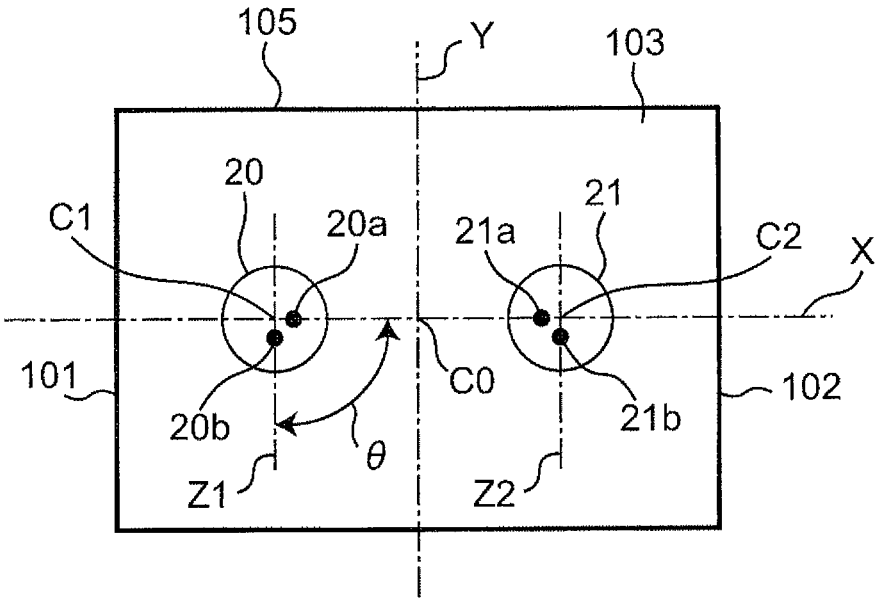
FIG. 3 is a plan view illustrating radiation portions which are placed on a bottom wall surface in the microwave heating device according to the first embodiment.

FIG. 1 is a perspective view illustrating the inside of a heating chamber 100 in a microwave oven as a microwave heating device according to a first embodiment of the present invention. In FIG. 1, the inside of the heating chamber 100 is partially cutout, and an openable door for opening and closing the heating chamber 100 is not illustrated. FIG. 2 is a block diagram illustrating the structure of the microwave heating device according to the second embodiment. FIG. 3 is a plan view illustrating radiation portions 20 and 21 placed on a bottom wall surface in the microwave heating device according to the second embodiment.

As illustrated in FIG. 1, the microwave heating device according to the first embodiment of the present invention includes the heating chamber 100 having a substantially rectangular parallelepiped structure for housing an object to be heated and, further, is structured to perform heating processing on the to-be-heated object housed within the heating chamber 100 with microwaves from the plural radiation portions 20 and 21. The heating chamber 100 is constituted by a left wall surface 101, a right wall surface 102, a bottom wall surface 103, an upper wall surface 104 and a back wall surface 105 which are made of a metal material and, further, is constituted by the openable door (not illustrated) adapted to be opened and closed for housing the to-be-heated object therein. The heating chamber 100 is structured to enclose, inside the heating chamber 100, the microwaves radiated from the radiation portions 20 and 21 provided on the bottom wall surface 103, in a state where the openable door is closed.

As illustrated in FIG. 2, a microwave generating portion 10 as a microwave generating means is constituted by a microwave oscillation portion 10*a*, initial-stage amplification portions 15*a*, 15*b*, 15*c* and 15*d* (which will be referred to as 15*a* to 15*d*, and other plural components will be similarly abbreviated, in the following description) which are supplied with four outputs from the microwave oscillation portion 10*a* through microwave transmission paths 14*a* to 14*d*, main amplification portions 16*a* to 16*d* for further amplifying the respective outputs of the initial-stage amplification portions 15*a* to 15*d*, and electric-power detecting portions 18*a* to 18*d* inserted in respective microwave transmission paths 17*a* to 17*d* for directing the outputs of the main amplification portions 16*a* to 16*d* to respective output portions 19*a* to 19*d*. The initial-stage amplification portions 15*a* to 15*d*, and the main amplification portions 16*a* to 16*d* in the microwave generating portion 10 are constituted by respective semiconductor devices.

The microwave oscillation portion 10*a* in the microwave generating portion 10 includes a quartz oscillator 11 as a reference-signal oscillator, phase variable portions 12*a* to 12*b* provided at the four outputs from the quartz oscillator 11, and phase-locked loops 13*a* to 13*d* to which the outputs of the phase variable portions 12*a* to 12*b* are inputted. The quartz oscillator 11 as the reference-signal oscillator, which is employed in the first embodiment, is adapted to generate a reference frequency of 10 MHz, for example.

The quartz oscillator 11 and the phase-locked loops 13*a* to 13*d* are formed from a frequency negative feedback circuit, and are formed to be a PLL frequency synthesizer which incorporates circuit techniques for PLLs (Phase Locked Loops). The PLL frequency synthesizer is constituted by a voltage controlled oscillator (VCO), a frequency divider having a frequency-division value which is variably controlled by control signals from outside, a phase comparator, a loop filter, and the quartz oscillator 11 adapted to generate input reference signals. By controlling the frequency-division value in the frequency divider, it is possible to generate a frequency having a value which is multiple times the frequency value of the quartz oscillator 11, thereby causing the microwave oscillation portion 10*a* to output a predetermined oscillation frequency.

The phase comparator compares the value of the output frequency from the voltage controlled oscillator (VCO) which has been subjected to the frequency division by the frequency divider, with the frequency of the input reference signals obtained from the quartz oscillator 11. When both the values are different from each other, the phase comparator outputs an error signal pulse. The loop filter, which is constituted by a low-pass filter, is adapted to convert the error signal pulses generated from the phase comparator into a DC voltage, and this DC voltage is applied to the voltage controlled oscillator (VCO), thereby variably controlling the oscillation frequency of the voltage controlled oscillator (VCO). As described above, the frequency negative feedback circuit constituted by the phase-locked loops 13*a* to 13*d* and the quartz oscillator 11 as the reference-signal oscillator is adapted to operate, in such a way as to create a frequency determined by control signals from the outside.

In the microwave heating device according to the first embodiment of the present invention, the microwave oscillation portion 10*a* is structured to include the phase variable portions 12*a* to 12*b*, in addition to the aforementioned frequency negative feedback circuit. The plural outputs of the microwave oscillation portion 10*a* are controlled, in frequency, to the same frequency based on control signals from the outside, wherein the relative phase differences between each output terminal and the other output terminals are determined according to operating conditions of the phase variable portions 12*a* to 12*b*.

The phase variable portions 12*a* to 12*d* are structured to include variable capacitance diodes which are placed in parallel with the signal lines for transmitting the output of the quartz oscillator 11 to the respective phase-locked loops 13*a* to 13*d*.

As illustrated in FIG. 3, on the bottom wall surface 103 forming the heating chamber 100, there are placed the plural (two, in the first embodiment) radiation portions (20, 21) for radiating and supplying microwaves to the inside of the heating chamber 100. The two radiation portions (the first radiation portion 20 and the second radiation portion 21) according to the first embodiment are placed at positions symmetrical with respect to a center line in the forward and rearward direction of the device (a line represented by a reference character Y in FIG. 3), which passes through an approximate-center point (C0) of the bottom wall surface 103.

The first radiation portion 20 includes two microwave feeding points 20*a* and 20*b*, wherein the respective outputs of the microwave generating portion 10 are directed to the microwave feeding points 20*a* and 20*b*. Similarly, the second radiation portion 21 includes two microwave feeding points 21*a* and 21*b*, wherein the respective outputs of the microwave generating portion 10 are directed to the microwave feeding points 21*a* and 21*b*. The microwave feeding points 20*a* and 20*b* in the first radiation portion 20 and the microwave feeding points 21*a* and 21*b* in the second radiation portion 21 are placed at positions symmetrical with respect to the aforementioned center axis Y of the bottom wall surface 103.

The first radiation portion 20 and the second radiation portion 21 are antennas having a substantially-disk shape, and the first microwave feeding points 20*a* and 21*a* are placed on the line connecting the respective center points C1 and C2 to each other (the line represented by a reference character X in FIG. 3). The second microwave feeding points 20*b* and 21*b* are placed on the respective lines (the lines designated by reference characters Z1 and Z2 in FIG. 3) which pass through the center points C1 and C2 and also are orthogonal to the line X connecting the center points C1 and C2 to each other. The respective microwave feeding points 20*a*, 20*b* and 21*a* and 21*b* are placed such that they are spaced apart by predetermined distances from the center points C1 and C2 of the radiation portions 20 and 21, in order to attain impedance matching.

As described above, in the first radiation portion 20, the line X connecting the first microwave feeding point 20*a* and the center point C1 to each other, and the line Z1 connecting the second microwave feeding point 20*b* and the center point C1 to each other are placed to form an intersection angle θ of 90 degrees, therebetween. Similarly, in the second radiation portion 21, the line X connecting the first microwave feeding point 21*a* and the center point C2 to each other, and the line Z2 connecting the second microwave feeding point 21*b* and the center point C2 to each other are placed to form an intersection angle θ of 90 degrees, therebetween.

In the microwave heating device according to the first embodiment, the initial-stage amplification portions 15*a* to 15*d* and the main amplification portions 16*a* to 16*d* include circuits formed from conductive patterns formed on a single surface of a dielectric substrate made of a low dielectric loss material, wherein, in order to preferably operate the semiconductor devices constituting the amplification devices in the respective amplification portions provided in the circuits, each of the semiconductor devices is provided with matching circuits at the input and output sides thereof.

The microwave transmission paths 14*a* to 14*d* from the outputs of the microwave oscillation portion 10*a* to the initial-stage amplification portions 15*a* to 15*d* are formed from coaxial cables. Further, the microwave transmission paths 17*a* to 17*d* from the main amplification portions 16*a* to 16*d* to the output portions 19*a* to 19*d* are formed from transmission circuits with characteristic impedances of about 50 ohms, from conductive patterns provided on a single surface of a dielectric substrate.

Since the microwave transmission paths 14*a* to 14*d* are formed from coaxial cables, it is possible to conveniently place the microwave oscillation portion 10*a* and the amplification portions (15*a* to 15*d*, 16*a* to 16*d*) at different positions. The phase variable portions 12*a* to 12*d* each have a circuit structure incorporating a variable capacitance diode between a signal line and a ground surface. By varying the voltage applied to the variable capacitance diode, a delay is induced in the phase of the reference frequency. Therefore, the reference frequency having been delayed in phase is inputted to the respective phase-locked loops 13*a* to 13*d*.

Since the phase variable portions 12*a* to 12*d* are incorporated in the transmission paths for the reference frequency, it is possible to employ variable capacitance diodes usable in environments with lower electric-power levels and lower frequencies, and also it is possible to set larger phase changes in microwave output signals from the microwave oscillation portion 10*a*.

The phase-locked loops 13*a* to 13*d* in the microwave generating portion 10 are adapted to create, with the frequency divider, a comparative frequency having frequency-division performance of 0.5 MHz, for the quartz oscillator 11 as the reference-signal oscillator which generates a reference frequency of 10 MHz, for example. Further, the microwave signals inputted to the subsequent amplification portions have a frequency in the range of 2400.0 MHz to 2500.0 MHz.

When the microwave signals have a frequency of 2450.0 MHz, the amounts of phase changes in the phase variable portions 12*a* to 12*d* are controlled, such that the phase of the microwaves can be changed by 360 degrees. By controlling the phase variable portions 12*a* to 12*d*, it is possible to control the phases at the output portions 19*a* to 19*d* in the microwave generating portion 10. Namely, it is possible to induce phase delays of up to 360 degrees, at the microwave feeding points 20*a* and 20*b* in the first radiation portion 20 and the microwave feeding points 21*a* and 21*b* in the second radiation portion 21.

The electric-power detection portions 18*a* to 18*d* are adapted to detect microwave electric power transmitted from the microwave generating portion 10 toward the heating chamber 100 (hereinafter, referred to as the amounts of supplied microwaves), and electric power of so-called reflected waves which are transmitted from the heating chamber 100 to the microwave generating portion 10 (hereinafter, referred to as the amounts of reflected microwaves). Also, the electric-power detection portions 18*a* to 18*d* can be also structured to detect at least the amounts of reflected microwaves. The electric-power detection portions 18*a* to 18*d* are adapted to extract amounts of electric power which are about 1/10000 the amounts of reflected microwaves and/or the amounts of supplied microwaves transmitted through the microwave transmission paths 17*a* to 17*d*, by setting the degree of electric-power coupling to about 40 dB, for example.

The electric-power signals extracted as described above are subjected to rectification by detector diodes (not illustrated) and, then, are subjected to smoothing processing by capacitors (not illustrated), and the signals having been subjected to the smoothing processing are inputted to a control portion 22.

The control portion 22 controls the phase-locked loops 13*a* to 13*d*, which are constituents of the microwave generating portion 10, for controlling the oscillating frequency and the oscillating output of the microwave oscillation portion 10*a* and, also, controls the phase variable portions 12*a* to 12*d* for controlling the amounts of phase delays in the oscillating signals, based on conditions for heating a to-be-heated object, which have been inputted by a user (an arrow Q in FIG. 2), and based on detection information from the respective electric-power detection portions 18*a* to 18*d* (an arrow P in FIG. 2), and heating information acquired from various types of sensors for detecting the state where the to-be-heated object is being heated during heating (an arrow R in FIG. 2). As a result thereof, the to-be-heated object being housed within the heating chamber 100 can be optimally heated, based on the heating conditions (Q) set by the user, the heating information (R) indicating the state where the to-be-heated object is being heated, or the detection information (P) from the electric-power detection portions 18*a* to 18*d*.

Further, in the microwave heating device according to the first embodiment, the microwave generating portion 10 is provided with cooling fins (not illustrated), for example, as heat-dissipation means for dissipating heat generated from the semiconductor devices. Further, within the heating chamber 100, there is provided a placement plate 25 for covering the radiation portions 20 and 21 provided on the bottom wall surface 103 and for placing and housing a to-be-heated object thereon, wherein the placement plate 25 is made of a low dielectric loss material.

[Aspects of Radiations]

Next, there will be described the radiation portions 20 and 21 in the microwave heating device having the aforementioned structure according to the first embodiment, in terms of aspects of radiations and operations thereof.

[Description of First Aspect of Radiations]

Figure 4:
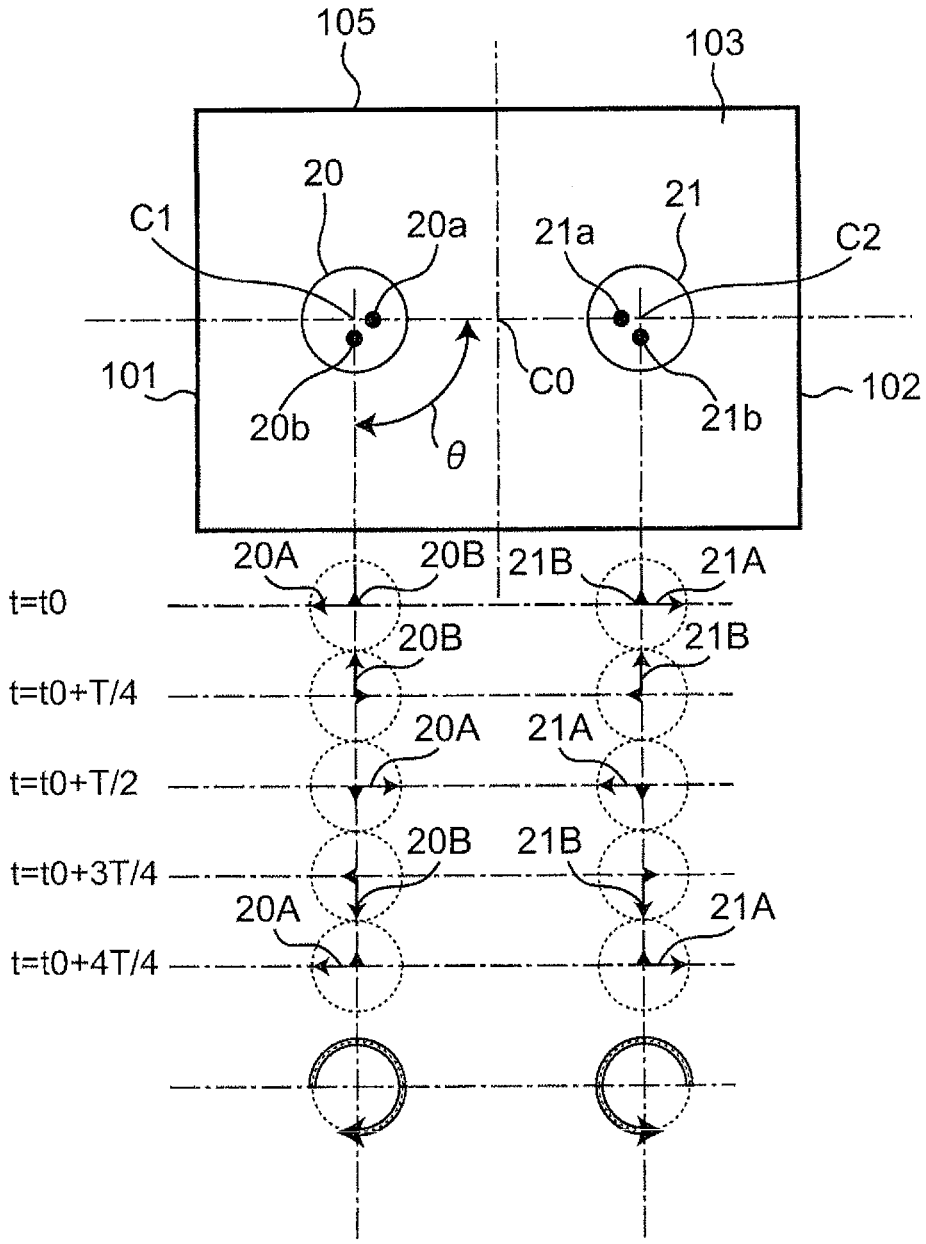
FIG. 4 is a view illustrating a first aspect of radiations from the radiation portions in the microwave heating device according to the second embodiment.

FIG. 4 is a view illustrating an aspect of radiations from the radiation portions 20 and 21 in the microwave heating device according to the first embodiment, illustrating a first aspect of radiations.

In the first aspect of radiations illustrated in FIG. 4, the second microwave feeding point 20*b* is fed with electricity at a feeding phase delayed by 90 degrees from the feeding phase for the first microwave feeding point 20*a* in the first radiation portion 20. Similarly, the second microwave feeding point 21*b* is fed with electricity at a feeding phase delayed by 90 degrees from the feeding phase for the first microwave feeding point 21*a* in the second radiation portion 21. Further, the feeding phase for the first microwave feeding point 20*a* in the first radiation portion 20 is the same as the feeding phase for the first microwave feeding point 21*a* in the second radiation portion 21.

Here, the phase delay of 90 degrees is expressed as a characteristic value at the center frequency (for example, 2450 MHz) in the frequency range used in the microwave heating device.

As described above, by placing the microwave feeding points 20*a*, 20*b*, 21*a* and 21*b* at predetermined positions in the respective radiation portions 20 and 21, and by employing the first aspect of radiations where there is provided a phase difference of 90 degrees between the microwaves supplied to the microwave feeding points 20*a* and 20*b*, and 21*a* and 21*b*, the respective radiation portions 20 and 21 are caused to radiate microwaves forming circularly polarized waves.

With reference to FIG. 4, there will be described the mechanism for generating such circularly polarized waves in the second aspect of radiations.

Assuming that, at a time t=t0, the microwaves fed to the first microwave feeding points 20*a* and 21*a* have a phase (absolute phase) of 90 degrees, at this time, the phase (absolute phase) of the microwaves fed to the second microwave feeding points 20*b* and 21*b* is delayed by 90 degrees from the feeding phase for the first microwave feeding points 20*a* and 20*b* and, therefore, is 0 degree.

Accordingly, at the time t=t0, the microwaves from the first microwave feeding points 20*a* and 21*a* induce microwave electric fields in directions opposite from each other (microwave electric fields designated by arrows 20A and 21A in FIG. 4). At this time, the microwaves fed to the second microwave feeding points 20*b* and 21*b* have a phase (absolute phase) of 0 degree, thereby inducing microwave electric fields with a magnitude of zero.

At a time t=t0+T/4 (T indicates the period), the microwaves fed to the first microwave feeding points 20*a* and 21*a* have a phase of 180 degrees, and the microwaves fed to the second microwave feeding points 20*b* and 21*b* have a phase of 90 degrees. Therefore, at the time t=t0+T/4, the microwaves from the second microwave feeding points 20*b* and 21*b* induce microwave electric fields in the same direction (microwave electric fields designated by arrows 20B and 21B in FIG. 4). At this time, the microwaves fed to the first microwave feeding points 20*a* and 21*a* have a phase of 180 degree, thereby inducing microwave electric fields with a magnitude of zero.

At a time t=t0+T/2, the microwaves fed to the first microwave feeding points 20*a* and 21*a* have a phase of 270 degrees, and the microwaves fed to the second microwave feeding points 20*b* and 21*b* have a phase of 180 degrees. This induces, at the time t=t0+T/2, microwave electric fields (microwave electric fields designated by arrows 20A and 21A in FIG. 4) in the opposite directions from those of the microwave electric fields at the time t=t0.

At a time t=t0+3T/4, the microwaves fed to the first microwave feeding points 20*a* and 21*a* have a phase of 360 degrees (0 degree), and the microwaves fed to the second microwave feeding points 20*b* and 21*b* have a phase of 270 degrees. This induces, at the time t=t0+3T/4, microwave electric fields (microwave electric fields designated by arrows 20B and 21B in FIG. 4) in the opposite directions from those of the microwave electric fields at the time t=t0+T/4.

At the time t=t0+4T/4, the microwaves from the first microwave feeding points 20*a* and 21*a* induce microwave electric fields in directions opposite from each other (microwave electric fields designated by arrows 20A and 21A in FIG. 4), similarly to at the time t=t0.

When the movements of the microwave electric fields which change with time as described above are overlaid on the surfaces of the radiation portions, as illustrated at a lowermost portion in FIG. 4, the microwave electric fields from the first radiation portion 20 generate right-hand circularly polarized waves, while the microwave electric fields from the second radiation portion 21 generate left-hand circularly polarized waves.

[Description of Second Aspect of Radiations]

Figure 5:
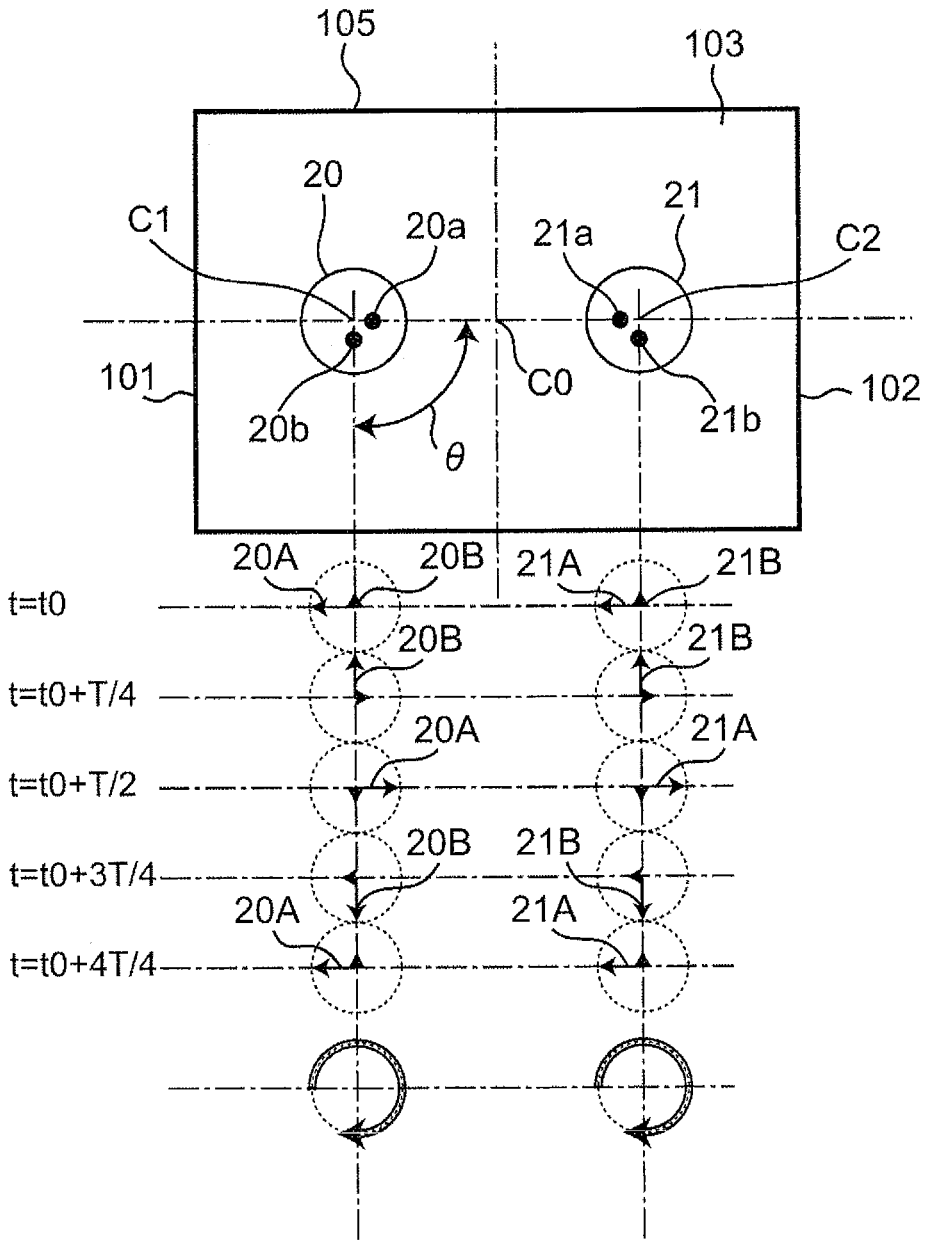
FIG. 5 is a view illustrating a second aspect of radiations from the radiation portions in the microwave heating device according to the first embodiment of the present invention.

FIG. 5 is a view illustrating a third aspect of radiations from the radiation portions 20 and 21 in the microwave heating device according to the first embodiment of the present invention.

In the second aspect of radiations illustrated in FIG. 5, the second microwave feeding point 20*b* in the first radiation portion 20 and the second microwave feeding point 21*b* in the second radiation portion 21 are fed with electricity at a feeding phase delayed by 90 degrees from the feeding phase for the first microwave feeding point 20*a* in the first radiation portion 20 and, further, the first microwave feeding point 21*a* in the second radiation portion 21 is fed with electricity at a feeding phase delayed by 180 degrees therefrom.

Here, the phase delay of 90 degrees and the phase delay of 180 degrees are expressed as characteristic values at the center frequency (for example, 2450 Hz) in the frequency range used in the microwave heating device.

In the second aspect of radiations, similarly, with the placement and the structure of the microwave feeding points 20*a*, 20*b*, 21*a* and 21*b*, and by providing a phase difference of 90 degrees between the microwaves fed to the microwave feeding points 20*a*, 20*b*, 21*a* and 21*b*, the respective radiation portions 20 and 21 are caused to radiate circularly polarized waves.

With reference to FIG. 5, there will be described the mechanism for generating such circularly polarized waves in the second aspect of radiations.

Assuming that, at a time t=t0, the microwaves fed to the first microwave feeding point 20*a* in the first radiation portion 20 have a phase (absolute phase) of 90 degrees, at this time, the phase (absolute phase) of the microwaves fed to the second microwave feeding points 20*b* and 21*b* is delayed by 90 degrees from the feeding phase for the first microwave feeding point 20*a* and, therefore, is 0 degree, while the phase (absolute phase) of the microwaves fed to the first microwave feeding point 21*a* in the second radiation portion 21 is −90 degrees (270 degrees).

Accordingly, at the time t=t0, the microwaves from the first microwave feeding points 20*a* and 21*a* induce microwave electric fields in the same direction (microwave electric fields designated by arrows 20A and 21A in FIG. 5). At this time, the microwaves fed to the second microwave feeding points 20*b* and 21*b* have a phase of 0 degree, thereby inducing no microwave electric field.

At a time t=t0+T/4 (T indicates the period), the microwaves fed to the first microwave feeding points 20*a* and 21*a* have respective phases of 180 degrees and 360 degrees, and the microwaves fed to the second microwave feeding points 20*b* and 21*b* have a phase of 90 degrees. This induces, at the time t=t0+T/4, microwave electric fields (microwave electric fields designated by arrows 20B and 21B in FIG. 5). At this time, the microwaves fed to the first microwave feeding points 20*a* and 21*a* have respective phases of 180 degree and 360 degrees, thereby inducing no microwave electric field.

At a time t=t0+T/2, the microwaves fed to the first microwave feeding points 20*a* and 21*a* have respective phases of 270 degrees and 90 degrees, and the microwaves fed to the second microwave feeding points 20*b* and 21*b* have a phase of 180 degrees. This induces, at the time t=t0+T/2, microwave electric fields (microwave electric fields designated by arrows 20A and 21A in FIG. 5) in the opposite directions from those of the microwave electric fields represented at the time t=t0.

At a time t=t0+3T/4, the microwaves fed to the first microwave feeding points 20*a* and 21*a* have respective phases of 360 degrees and 180 degrees, and the microwaves fed to the second microwave feeding points 20*b* and 21*b* have a phase of 270 degrees. This induces, at the time t=t0+3T/4, microwave electric fields (microwave electric fields designated by arrows 20B and 21B in FIG. 5) in the opposite directions from those of the microwave electric fields represented at the time t=t0+T/4.

At the time t=t0+4T/4, the microwaves from the first microwave feeding points 20*a* and 21*a* induce microwave electric fields in the same direction (microwave electric fields designated by arrows 20A and 21A in FIG. 5), similarly to at the time t=t0.

When the movements of the microwave electric fields which change with time as described above are overlaid on the surfaces of the radiation portions, as illustrated at a lowermost portion in FIG. 5, the microwave electric fields from the first radiation portion 20 and the second radiation portion 21 induce the same right-hand circularly polarized waves.

[Description of Second Aspect of Radiations]

Figure 6:
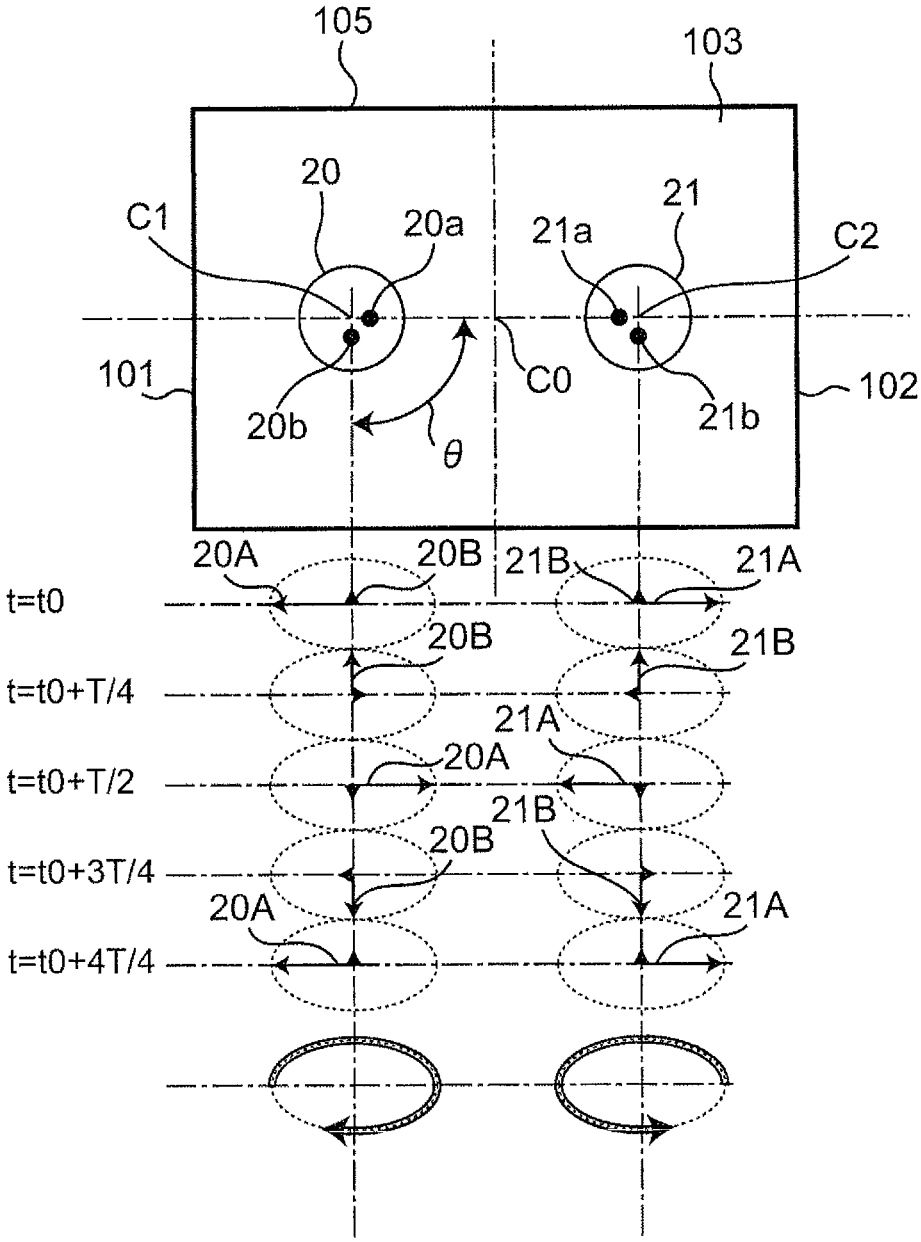
FIG. 6 is a view illustrating a third aspect of radiations from the radiation portions in the microwave heating device according to the first embodiment of the present invention.

FIG. 6 is a view illustrating a third aspect of radiations from the radiation portions 20 and 21 in the microwave heating device according to the first embodiment of the present invention.

In the third aspect of radiations illustrated in FIG. 6, the amounts of microwave electric power fed to the first microwave feeding points 20*a* and 21*a* in the respective radiation portions 20 and 21 are made larger than the amounts of microwave electric power fed to the second microwave feeding points 20*b* and 21*b*.

The feeding phases for the respective microwave feeding points 20*a*, 20*b*, 21*a* and 21*b* are the same as those in the first aspect of radiations illustrated in FIG. 4. Namely, in the respective radiation portions 20 and 21, the second microwave feeding points 20*b* and 21*b* are fed with electricity at a feeding phase delayed by 90 degrees from the feeding phase for the first microwave feeding points 20*a* and 21*a*.

In the third aspect of radiations, similarly, with the placement and the structure of the microwave feeding points 20*a*, 20*b*, 21*a* and 21*b*, and by providing a phase difference of 90 degrees between the microwaves fed to the microwave feeding points 20*a*, 20*b*, 21*a* and 21*b*, the respective radiation portions 20 and 21 are caused to radiate circularly polarized waves with an elliptical circling shape.

With reference to FIG. 6, there will be described the mechanism for generating such elliptical-shaped circularly polarized waves in the third aspect of radiations.

Assuming that, at a time t=t0, the microwaves fed to the first microwave feeding points 20*a* and 21*a* have a phase (absolute phase) of 90 degrees, at this time, the phase (absolute phase) of the microwaves fed to the second microwave feeding points 20*b* and 21*b* is delayed by 90 degrees from the feeding phase for the first microwave feeding points 20*a* and 20*b* and, therefore, is 0 degree.

A microwave electric field induced by feeding electricity has a magnitude which is proportional to the amount of microwave electric power supplied thereto. Therefore, in the third aspect of radiations, the microwaves from the first microwave feeding points 20*a* and 21*a* induce microwave electric fields with a larger magnitude than that of the microwave electric fields induced by the microwaves from the second microwave feeding points 20*b* and 21*b*. Accordingly, in FIG. 6, the microwave electric fields excited by the first microwave feeding points 20*a* and 21*a* are indicated by arrows having a larger length than that of arrows indicating the microwave electric fields excited by the second microwave feeding points 20*b* and 21*b*.

At a time t=t0, the microwaves from the first microwave feeding points 20*a* and 21*a* induce microwave electric fields in directions opposite from each other (microwave electric fields designated by arrows 20A and 21A in FIG. 6).

At a time t=t0+T/4 (T indicates the period), the microwaves fed to the first microwave feeding points 20*a* and 21*a* have a phase of 180 degrees, and the microwaves fed to the second microwave feeding points 20*b* and 21*b* have a phase of 90 degrees. Therefore, at the time t=t0+T/4, the microwaves from the second microwave feeding points 20*b* and 21*b* induce microwave electric fields in the same direction (microwave electric fields designated by arrows 20B and 21B in FIG. 6).

At a time t=t0+T/2, the microwaves fed to the first microwave feeding points 20*a* and 21*a* have a phase of 270 degrees, and the microwaves fed to the second microwave feeding points 20*b* and 21*b* have a phase of 180 degrees. This induces, at the time t=t0+T/2, microwave electric fields (microwave electric fields designated by arrows 20A and 21A in FIG. 6) in the opposite directions from those of the microwave electric fields represented at the time t=t0.

At a time t=t0+3T/4, the microwaves fed to the first microwave feeding points 20*a* and 21*a* have a phase of 360 degrees (0 degree), and the microwaves fed to the second microwave feeding points 20*b* and 21*b* have a phase of 270 degrees. This induces, at the time t=t0+3T/4, microwave electric fields (microwave electric fields designated by arrows 20B and 21B in FIG. 6) in the opposite directions from those of the microwave electric fields represented at the time t=t0+T/4.

At the time t=t0+4T/4, the microwaves from the first microwave feeding points 20*a* and 21*a* induce microwave electric fields (microwave electric fields designated by arrows 20A and 21A in FIG. 6) in directions opposite from each other, similarly to at the time t=t0.

When the movements of the microwave electric fields which change with time as described above are overlaid on the surfaces of the radiation portions, as illustrated at a lowermost portion in FIG. 6, the microwave electric fields from the first radiation portion 20 induce right-hand circularly polarized waves with an elliptical shape, while the microwave electric fields from the second radiation portion 21 induce left-hand circularly polarized waves with an elliptical shape.

In the microwave heating device according to the first embodiment which has been described above, since the two microwave feeding points 20*a* and 20*b* are placed orthogonally to each other in the first radiation portion 20, the microwaves supplied to the respective microwave feeding points 20*a* and 20*b* are radiated within the heating chamber, such that the electric powers of these microwaves are synthesized. Further, since the two microwave feeding points 21*a* and 21*b* are placed orthogonally to each other in the second radiation portion 21, the microwaves supplied to the respective microwave feeding points 21*a* and 21*b* are radiated within the heating chamber, such that the electric powers of these microwaves are synthesized.

Accordingly, with the structure of the microwave heating device according to the first embodiment of the present invention, by providing plural microwave generating means capable of generating relatively-smaller amounts of electric power and, further, by providing plural microwave feeding points in each radiation portion, it is possible to realize a structure capable of supplying larger electric power to the inside of the heating chamber, without increasing the number of radiation portions.

Further, by controlling the phase difference between the microwaves fed to the two microwave feeding points which are orthogonally placed in each radiation portion to be 90 degrees, it is possible to generate, from the radiation portions, microwave radiation patterns for forming circularly polarized waves.

Regarding the phase difference between the microwaves fed to the two microwave feeding points orthogonally placed in each radiation portion, assuming that the phase of the microwaves supplied to one of the microwave feeding portions is defined as a reference (0 degree), by changing the phase of the microwaves supplied to the other microwave feeding point to 90 degrees or −90 degrees (or −90 degrees or −270 degrees), it is possible to change the direction of circling of circularly polarized waves.

With the structure of the microwave heating device according to the first embodiment of the present invention, it is possible to disperse the microwaves radiated from the radiation portions over the entire heating chamber and, furthermore, it is possible to change over among aspects of radiations for forming various microwave-radiation patterns, thereby changing the microwave distribution within the heating chamber to desired states for facilitating heating of to-be-heated objects.

As described above, in the microwave heating device according to the first embodiment of the present invention, the plural radiation portions are placed on the same wall surface (for example, the bottom wall surface) in the heating chamber, and the plural radiation portions and the microwave feeding points therein are placed, on this wall surface, symmetrically with respect to a center line passing through an approximate center of this wall surface (the center axis Y in FIG. 3). With the microwave heating device having the aforementioned structure according to the first embodiment, since the radiation portions are concentrated on the single wall surface, it is possible to make it easier to place a member for covering the radiation portions for protecting these radiation portions and, furthermore, it is possible to make it easier to control microwave signals supplied to the microwave feeding points in the respective radiation portions and the phases of these microwave signals, in association with one another.

Further, in the first aspect of radiations (see FIG. 4) in the microwave heating device according to the first embodiment, in addition to delaying the feeding phase for the microwave feeding point 20*b* by 90 degrees from the feeding phase for the first microwave feeding point 20*a* in the first radiation portion 20 and by delaying the feeding phase for the microwave feeding point 21*b* by 90 degrees from the feeding phase for the first microwave feeding point 21*a* in the second radiation portion 21, it is possible to arbitrarily change the phase difference between the first microwave feeding point 20*a* in the first radiation portion 20 and the first microwave feeding point 21*a* in the second radiation portion 21.

By changing the phase difference between the microwaves radiated from the two radiation portions 20 and 21, as described above, it is possible to change the positions at which the microwaves radiated from the respective radiation portions 20 and 21 come into collision with each other, in the space within the heating chamber. This enables dispersing the distribution of microwaves within the heating chamber, thereby facilitating uniformization of heating of to-be-heated objects.

[Heating Operations]

There will be described operations for heating a to-be-heated object with the microwave heating device having the aforementioned structure according to the first embodiment.

At first, the openable door is opened, the to-be-heated object is placed on the placement plate 25 in the heating chamber 100, and the openable door is closed to seal the heating chamber 100. A user inputs conditions for heating this to-be-heated object, to an operation portion (not illustrated) provided in the microwave heating device and, then, the user pushes a heating start key. Since the heating start key has been pushed, a heating start signal is created and is inputted to a control portion 22. The control portion 22, to which the heating start signal has been inputted, outputs a control signal to the microwave generating portion 10, which causes the microwave generating portion 10 to start operating. At this time, the control portion 22 drives and controls the microwave generating portion 10, based on various types of information, such as the heating conditions Q for the to-be-heated object. Further, the control portion 22 operates a driving power supply (not illustrated) provided in the microwave heating device, for supplying electric power to the oscillation portion 11, the initial-stage amplification portions 15*a* to 15*d*, and the main amplification portions 16*a* to 16*d*.

When the microwave generating portion 10 starts operating, in the phase variable portions 12*a* to 12*d*, as an initial condition, the amounts of phase delays (the relative phases) in the phase variable portion 12*a* and the phase variable portion 12*c*, which are associated with the first microwave feeding point 20*a* in the first radiation portion 20 and the first microwave feeding point 21*a* in the second radiation portion 21, are set to 0 degree. Further, the amounts of phase delays (the relative phases) in the phase variable portions 12*b* and 12*d*, which are associated with the second microwave feeding point 20*b* in the first radiation portion 20 and the second microwave feeding point 21*b* in the second radiation portion 21, are set to 90 degrees.

The control portion 22 operates the driving power supply for supplying electric power and control signals to the quartz oscillator 11, the phase variable portions 12*a* to 12*b* and the phase-locked loops 13*a* to 13*d*, which constitute the microwave oscillation portion 10*a*. At this time, the quartz oscillator 11 oscillates at a reference frequency of 10 MHz, for example, and the phase-locked loops 13*a* to 13*d* are supplied with signals for setting the output frequency thereof at 2400 MHz, for example, thereby causing the microwave oscillation portion 10*a* to start oscillating.

Further, when the microwave oscillation portion 10*a* starts oscillating, the control portion 22 controls the driving power supply for operating the initial-stage amplification portions 15*a* to 15*d* and, then, operating the main amplification portions 16*a* to 16*d*. As a result thereof, predetermined microwave electric-power signals are formed through the respective microwave transmission paths.

The respective microwave electric-power signals pass through the initial-stage amplification portions 15*a* to 15*d*, the main amplification portions 16*a* to 16*d*, and the electric-power detection portions 18*a* to 18*d*, which are operated in parallel, and, then, the respective microwave electric-power signals are outputted from the respective output portions 19*a* to 19*d*. The microwave electric-power signals outputted from the output portions 19*a* to 19*d* are transmitted to the respective microwave feeding points 20*a*, 20*b*, 21*a* and 21*b* in the radiation portions 20 and 21 and, thus, microwaves are radiated, therefrom, to the inside of the heating chamber 100.

In the microwave heating device according to the first embodiment, each of the main amplification portions 16*a* to 16*d* is structured to output microwave electric power equivalent to 1/10 the rated output, such as microwave electric power of less than 50 W, such as 20 W, for example, in a stage prior to the start of actual heating of the to-be-heated object.

If the to-be-heated object absorbs 100% of the microwave electric power supplied to the inside of the heating chamber 100, no reflected electric power transmitted toward the microwave generating portion 10 from the heating chamber 100 is generated. However, since the electric characteristics of the heating chamber 100 including the to-be-heated object are determined by the type, the shape and the volume of the to-be-heated object, the to-be-heated object does not absorb all the supplied microwave electric power, which induces reflected electric power transmitted toward the microwave generating portion 10 from the heating chamber 100, based on the output impedance of the microwave generating portion 10 and the impedance of the heating chamber 100.

The electric-power detection portions 18*a* to 18*d* are adapted to be coupled to at least the reflected electric power transmitted toward the microwave generating portion 10 from the heating chamber 100, in the microwave transmission paths 17*a* to 17*d*, and to output detection signals proportional to the amounts of the reflected electric power (the amounts of reflected microwaves). The detection signals are inputted to the control portion 22, which calculates the total sum of the detection signals outputted from the respective electric-power detection portions 18*a* to 18*d*.

This calculation is performed for all frequencies within the frequency range used in the microwave heating device (with a pitch of 1 MHz, for example). Based on the results of the calculations, the control portion 22 extracts frequencies each of which causes the total sum of the signals corresponding to the reflected electric power to have a minimum value with respect to the frequency and, further, selects a frequency which causes this total sum to have a smallest value, out of the group of plural minimum values, as an oscillation frequency in heating the to-be-heated object (a frequency selection operation).

The aforementioned frequency selection operation is performed in a stage prior to the start of actual heating operations on the to-be-heated object. In this frequency selection operation, the control portion 22 increases the oscillating frequency of the microwave oscillation portion 10*a* from an initial value of 2400 MHz to an upper limit of 2500 MHz within the frequency variation range, with a 1-MHz pitch (for example, a variation speed of 1 MHz per 10 milliseconds). The frequencies each of which caused the total sum of the signals corresponding to the reflected electric power to be minimum, and the signals corresponding to the reflected electric power at these frequencies, which have been obtained through the frequency variation, are stored.

The control portion 22 selects, as an optimum oscillation frequency, a frequency which caused the signals corresponding to the reflected electric power to have a smallest value, out of the group of frequencies each of which caused the total sum of the signals corresponding to the reflected electric power to have a minimum value. Further, the control portion 22 controls the microwave oscillation portion 10*a* such that it oscillates at the selected optimum oscillation frequency and, further, controls the microwave generating portion 10 in such a way as to generate outputs corresponding to the set heating conditions Q.

If the inputted heating conditions Q are such conditions that heating operations should be performed on the to-be-heated object with the rated output, in the microwave generating portion 10, each of the main amplification portions 16*a* to 16*d* is caused to output microwave electric power of 200 W to 300 W, for example, in the actual heating operations on the to-be-heated object. The outputs from the respective main amplification portions 16*a* to 16*d* are transmitted to the microwave feeding points 20*a*, 20*b*, 21*a* and 21*b* in the radiation portions 20 and 21 and, further, are radiated therefrom to the inside of the heating chamber 100.

In the microwave heating device according to the first embodiment, based on detection signals from an infrared-ray detection portion adapted to detect the temperature at the surface of the to-be-heated object, which is provided for monitoring the state of progress of heating of the to-be-heated object, or based on detection signals indicative of amounts of reflected electric power detected by the respective electric-power detection portions 18*a* to 18*d*, the amounts of phase delays in the phase variable portions 12*a* to 12*d* are variably controlled, in order to finish the heating of the to-be-heated object in a desired state. The combination of the amounts of phase delays in the phase variable portions 12*a* to 12*d* can be determined by, for example, combining the first to third aspects of radiations described in the first embodiment, and by properly making selections therefrom according to the heating conditions Q for the to-be-heated object, the detection information P and the heating information R.

Further, while the microwave heating device according to the first embodiment has been described as having a structure which places the two radiation portions 20 and 21 on the bottom wall surface, at positions symmetrical with respect to the center line (the line designated by the reference character Y in FIG. 3) in the forward and rearward directions of the device, the radiation portions can be placed at positions symmetrical with respect to the center line (the line designated by the reference character X in FIG. 3) in the leftward and rightward directions of the device.

Also, the two radiation portions 20 and 21 can be structured such that their relative phases are variable, and the aforementioned first to third aspects of radiations can be properly combined for performing heating operations on to-be-heated objects.

Further, while there has been described an example where the microwave heating device according to the first embodiment employs the two radiation portions 20 and 21, the present invention can be also applied to a microwave heating device having a structure provided with two or more radiation portions according to specifications of the microwave heating device, and the like.

Second Embodiment

Next, there will be described a microwave heating device according to a second embodiment of the present invention, with reference to FIGS. 7 to 11. The microwave heating device according to the second embodiment is different from the microwave heating device according to the aforementioned first embodiment in that each radiation portion has three microwave feeding points, but is the same as the microwave heating device according to the first embodiment in terms of the other points. Accordingly, in the description of the second embodiment, components having the same functions and structures as those of the aforementioned first embodiment will be designated by the same reference characters, and descriptions thereof will be omitted by substituting the description in the first embodiment therefor.

Figure 7:
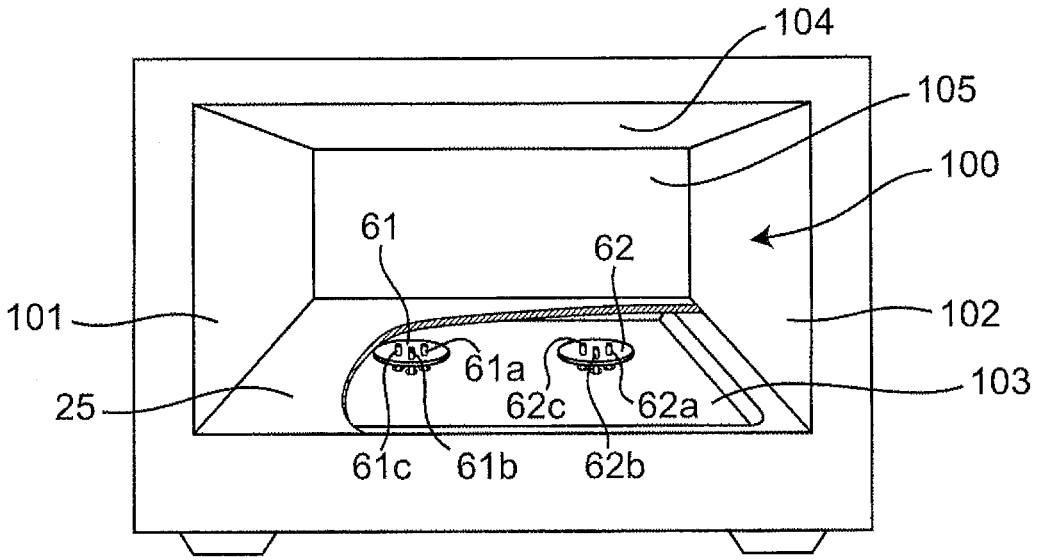
FIG. 7 is a perspective view illustrating the inside of a heating chamber in a microwave oven as a microwave heating device according to a second embodiment of the present invention.
Figure 8:
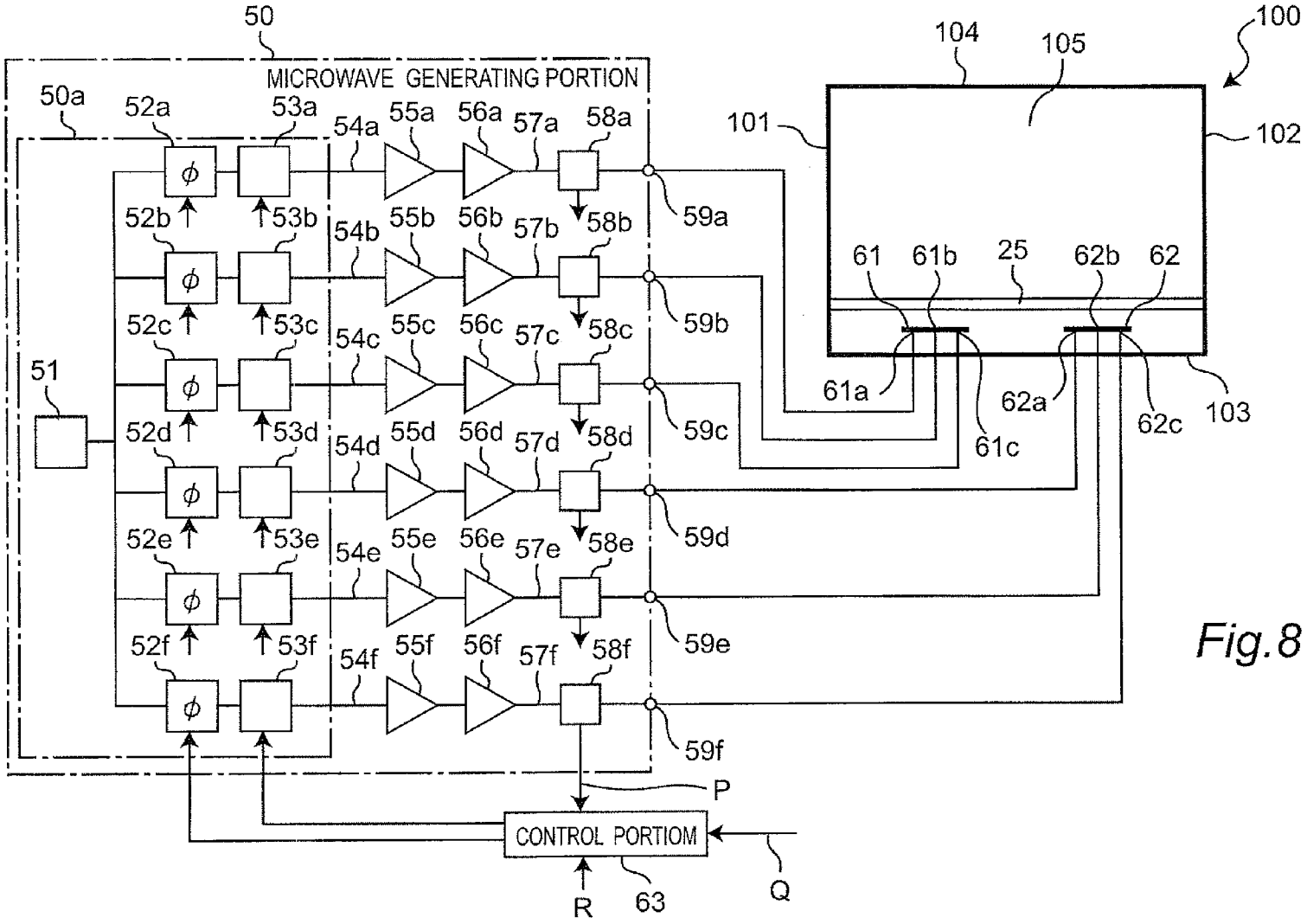
FIG. 8 is a block diagram illustrating the structure of the microwave heating device according to the second embodiment.
Figure 9:
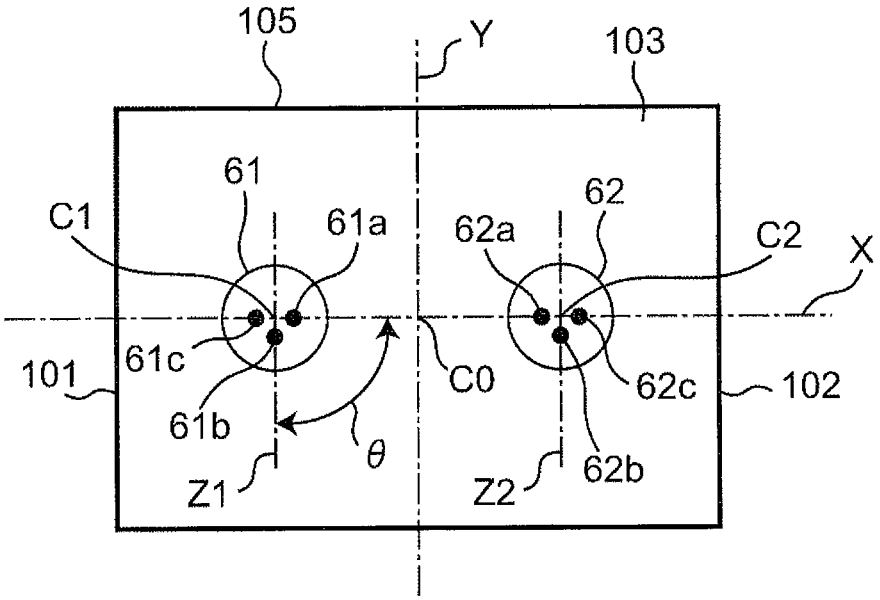
FIG. 9 is a plan view illustrating radiation portions which are placed on a bottom wall surface in the microwave heating device according to the second embodiment.

FIG. 7 is a perspective view illustrating the inside of a heating chamber 100 in a microwave oven as a microwave heating device according to the second embodiment. In FIG. 7, the inside of the heating chamber 100 is cutout at a portion (a placement plate 25) thereof, and an openable door for opening and closing the heating chamber 100 is not illustrated. FIG. 8 is a block diagram illustrating the structure of the microwave heating device according to the second embodiment. FIG. 9 is a plan view illustrating radiation portions 61 and 62 placed on a bottom wall surface in the microwave heating device according to the second embodiment.

As illustrated in FIG. 7, in the microwave heating device according to the second embodiment, the heating chamber 101 is constituted by a left wall surface 101, a right wall surface 102, the bottom wall surface 103, an upper wall surface 104 and a back wall surface 105 which are made of a metal material and, further, is constituted by the openable door (not illustrated) adapted to be opened and closed for housing the to-be-heated object therein. In the heating chamber 100, the two radiation portions 61 and 62 are provided on the bottom wall surface 103.

As illustrated in FIG. 8, a microwave generating portion 50 as a microwave generating means is constituted by a microwave oscillation portion 50*a*, initial-stage amplification portions 55*a*, 55*b*, 55*c*, 55*d*, 55*e* and 55*f* (which will be referred to as 54*a* to 54*f*, and other plural components will be similarly abbreviated, in the following description) which are supplied with six outputs from the microwave oscillation portion 50*a* through microwave transmission paths 54*a* to 54*f*, main amplification portions 56*a* to 56*f* for further amplifying the respective outputs of the initial-stage amplification portions 55*a* to 55*f*, and electric-power detecting portions 58*a* to 58*f* inserted in respective microwave transmission paths 57*a* to 57*f* for directing the outputs of the main amplification portions 56*a* to 56*f* to respective output portions 59*a* to 59*f*. The initial-stage amplification portions 55*a* to 55*f*, and the main amplification portions 56*a* to 56*f* in the microwave generating portion 50 are constituted by respective semiconductor devices.

The microwave oscillation portion 50*a* in the microwave generating portion 50 includes a quartz oscillator 51 as a reference-signal oscillator, phase variable portions 52*a* to 52*f* provided at the six outputs from the quartz oscillator 51, and phase-locked loops 53*a* to 53*f* to which the outputs of the phase variable portions 52*a* to 52*f* are inputted. The quartz oscillator 11 as the reference-signal oscillator, which is employed in the second embodiment, is adapted to generate a reference frequency of 10 MHz, for example.

Further, the structures and operations of the phase-locked loops 53*a* to 53*f* and peripheries thereof in the second embodiment are the same as the structures and operations described in the aforementioned first embodiment and will not be described in the second embodiment.

As illustrated in FIG. 9, on the bottom wall surface 103 forming the heating chamber 100, there are placed the plural (two, in the first embodiment) radiation portions (61, 62) for radiating and supplying microwaves to the inside of the heating chamber 100. The two radiation portions (the first radiation portion 61 and the second radiation portion 62) according to the second embodiment are placed at positions symmetrical with respect to a center line in the forward and rearward direction of the device (a line represented by a reference character Y in FIG. 9), which passes through an approximate-center point (C0) of the bottom wall surface 103.

The first radiation portion 61 has three microwave feeding portions 61*a*, 61*b* and 61*c*, wherein the respective outputs of the microwave generating portion 50 are directed to the microwave feeding points 61*a*, 61*b* and 61*c*. Similarly, the second radiation portion 62 has three microwave feeding portions 62*a*, 62*b* and 62*c*, wherein the respective outputs of the microwave generating portion 50 are directed to the microwave feeding points 62*a*, 62*b* and 62*c*. These microwave feeding portions 61*a*, 61*b* and 61*c* and 62*a*, 62*b* and 62*c* are placed at positions symmetrical with respect to the center line in the forward and rearward directions of the device (the line designated by a reference character Y in FIG. 9), which passes through an approximate-center point of the bottom wall surface 103.

The first radiation portion 61 and the second radiation portion 62 are antennas having a substantially-circular shape, and the first microwave feeding portions 61*a* and 62*a* and the third microwave feeding portions 61*c* and 62*c* are placed on the line connecting the respective center points C1 and C2 to each other (a line represented by a reference character X in FIG. 9). The second microwave feeding portions 61*b* and 62*b* are placed on respective lines (lines designated by reference characters Z1 and Z2 in FIG. 9) which pass through the center points C1 and C2 and are orthogonal to the line X connecting the center points C1 and C2 to each other.

The respective microwave feeding points 61*a*, 61*b* and 61*c* and 62*a*, 62*b* and 62*c* are placed such that they are spaced apart by predetermined distances from the respective center points C1 and C2 of the radiation portions 61 and 62, in order to attain impedance matching.

As described above, in the first radiation portion 61, the line X connecting the first microwave feeding point 61*a*, the third microwave feeding point 61*c* and the center point C1 to each other, and the line Z1 connecting the second microwave feeding point 61*b* and the center point C1 to each other are placed to form an intersection angle θ of 90 degrees, therebetween. Similarly, in the second radiation portion 62, the line X connecting the first microwave feeding point 62*a*, the third microwave feeding point 62*c* and the center point C2 to each other, and the line Z2 connecting the second microwave feeding point 62*b* and the center point C2 to each other are placed to form an intersection angle θ of 90 degrees, therebetween.

In the microwave heating device according to the second embodiment, the initial-stage amplification portions 55*a* to 55*f* and the main amplification portions 56*a* to 56*f* include circuits formed from conductive patterns formed on a single surface of a dielectric substrate made of a low dielectric loss material, wherein, in order to preferably operate the semiconductor devices constituting the amplification devices in the respective amplification portions provided in the circuits, each of the semiconductor devices is provided with matching circuits at the input and output sides thereof.

The microwave transmission paths 54*a* to 54*f* from the outputs of the microwave oscillation portion 50*a* to the initial-stage amplification portions 55*a* to 55*f* are formed from coaxial cables. Further, the microwave transmission paths 57*a* to 57*f* from the main amplification portions 56*a* to 56*f* to the output portions 59*a* to 59*f* are formed from transmission circuits with characteristic impedances of about 50 ohms, from conductive patterns provided on a single surface of a dielectric substrate.

The phase variable portions 52*a* to 52*f* each have a circuit structure incorporating a variable capacitance diode between a signal line and a ground surface. By varying the voltage applied to the variable capacitance diode, a delay is induced in the phase of the reference frequency. Therefore, the reference frequency having been delayed in phase is inputted to the respective phase-locked loops 53*a* to 53*f*.

Since the phase variable portions 52*a* to 52*f* are incorporated in the transmission paths for the reference frequency, it is possible to employ variable capacitance diodes usable in environments with lower electric-power levels and lower frequencies, and also it is possible to set larger phase changes in microwave output signals from the microwave oscillation portion 50*a*.

The phase-locked loops 53*a* to 53*f* in the microwave generating portion 50 are adapted to create, with the frequency divider, a comparative frequency having frequency-division performance of 0.5 MHz, for the quartz oscillator 11 as the reference-signal oscillator which generates a reference frequency of 10 MHz, for example. Further, the microwave signals inputted to the subsequent amplification portions have a frequency in the range of 2400.0 MHz to 2500.0 MHz.

When the microwave signals have a frequency of 2450.0 MHz, the amounts of phase changes in the phase variable portions 52*a* to 52*f* are controlled, such that the phase of the microwaves can be changed by 360 degrees. By controlling the phase variable portions 52*a* to 52*f*, it is possible to control the phases at the output portions 59*a* to 59*f* in the microwave generating portion 50. Namely, it is possible to induce phase delays of up to 360 degrees, at the microwave feeding points 61*a*, 61*b* and 61*c* in the first radiation portion 61 and the microwave feeding points 62*a*, 62*b* and 62*c* in the second radiation portion 62.

Since the phase-locked loops 53*a* to 53*f* in the microwave generating portion 50 are formed to be a PLL frequency synthesizer as described above, it is possible to output microwave signals therefrom through the application of voltages thereto and, further, it is possible to stop the outputting of microwave signals therefrom through cutoff of the voltages thereto.

The electric-power detection portions 58*a* to 58*f* are adapted to detect microwave electric power transmitted from the microwave generating portion 50 toward the heating chamber 100 (hereinafter, referred to as the amounts of supplied microwaves), and electric power of so-called reflected waves which are transmitted from the heating chamber 100 to the microwave generating portion 50 (hereinafter, referred to as the amounts of reflected microwaves). Further, the electric-power detection portions 58*a* to 58*f* can be also structured to detect at least the amounts of reflected microwaves. The electric-power detection portions 58*a* to 58*f* are adapted to extract amounts of electric power which are about 1/10000 the amounts of reflected microwaves and/or the amounts of supplied microwaves transmitted through the microwave transmission paths 57*a* to 57*f*, by setting the degree of electric-power coupling to about 40 dB, for example.

The electric-power signals extracted as described above are subjected to rectification by detector diodes (not illustrated) and, then, are subjected to smoothing processing by capacitors (not illustrated), and the signals having been subjected to the smoothing processing are inputted to a control portion 63.

The control portion 63 controls the phase-locked loops 53*a* to 53*f*, which are constituents of the microwave generating portion 50, for controlling the oscillating frequency and the oscillating output of the microwave oscillation portion 10*a* and, also, controls the phase variable portions 52*a* to 52*f* for controlling the amounts of phase delays in the oscillating signals, based on conditions for heating a to-be-heated object, which have been inputted by a user (an arrow Q in FIG. 8), and based on detection information from the respective electric-power detection portions 58*a* to 58*f* (an arrow P in FIG. 8), and heating information acquired from various types of sensors for detecting the state where the to-be-heated object is being heated during heating (an arrow R in FIG. 8). As a result thereof, the to-be-heated object being housed within the heating chamber 100 can be optimally heated, based on the heating conditions (Q) set by the user, the heating information (R) indicating the state where the to-be-heated object is being heated, or the detection information (P) from the electric-power detection portions 58*a* to 58*f*.

Further, in the microwave heating device according to the second embodiment, the microwave generating portion 50 is provided with cooling fins (not illustrated), for example, as heat-dissipation means for dissipating heat generated from the semiconductor devices. Further, within the heating chamber 100, there is provided a placement plate 25 for covering the radiation portions 61 and 62 provided on the bottom wall surface 103 and for placing and housing a to-be-heated object thereon, wherein the placement plate 25 is made of a low dielectric loss material.

[Aspects of Radiations]

Next, there will be described the radiation portions 61 and 62 in the microwave heating device having the aforementioned structure according to the second embodiment, in terms of aspects of radiations and operations thereof. Further, in the aspects of radiations from the radiation portions 61 and 62 according to the second embodiment, similarly, by placing microwave feeding points in such a way as to realize the same placement and structure as those in the first embodiment, and by controlling the feeding of microwave electric power to these microwave feeding points, it is possible to radiate circularly polarized waves. Namely, by cutting off the microwaves fed to the third microwave feeding points 61*c* and 62*c* in the radiation portions 61 and 62 according to the second embodiment, through the control of the phase-locked loops 53*c* and 53*f* corresponding thereto, it is possible to realize the same placement and structure as those of the aforementioned first embodiment, thereby enabling radiations of microwaves in the aforementioned first to third aspects of radiations.

Accordingly, in the following description, there will be described other aspects of radiations using the microwave feeding points 61*c* and 62*c* which are newly added in the second embodiment.

[Description of Fourth Aspect of Radiations]

Figure 10:
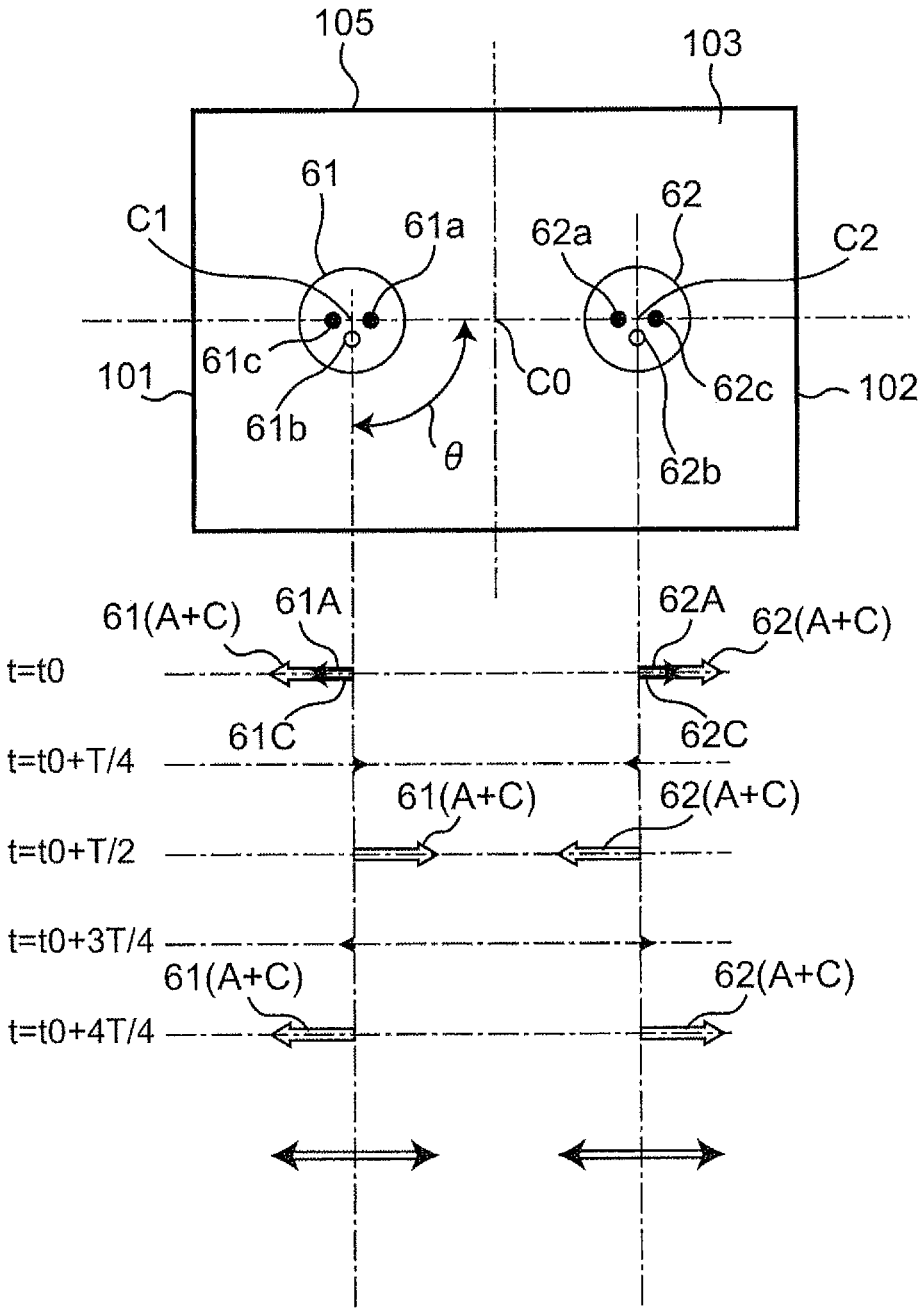
FIG. 10 is a view illustrating a fourth aspect of radiations from the radiation portions in the microwave heating device according to the second embodiment.

FIG. 10 is a view illustrating a fourth aspect of radiations from the radiation portions 61 and 62 in the microwave heating device according to the second embodiment.

In the fourth aspect of radiations illustrated in FIG. 10, the third microwave feeding points 61*c* and 62*c* are fed with electricity at a feeding phase delayed by 180 degrees from the feeding phase for the first microwave feeding points 61*a* and 62*a* in the respective radiation portions 61 and 62. Further, feeding of electricity to the second microwave feeding points 61*b* and 62*b* is cut off. Further, electricity fed to the second microwave feeding points 61*b* and 62*b* is cut off. In FIG. 10, the microwave feeding points which are fed with electricity (61*a*, 61*c*, 62*a*, 62*c*) are indicated by black circle marks, while the microwave feeding points which are not fed with electricity (61*b*, 61*b*) are indicated by while circle marks.

Here, the phase delay of 180 degrees is expressed as a characteristic value at the center frequency (for example, 2450 MHz) in the frequency range used in the microwave heating device.

As described above, by placing the microwave feeding points 61*a*, 61*b*, 61*c*, 62*a*, 62*b* and 62*c* in the respective radiation portions 61 and 62, and by employing the fourth aspect of radiations where there is provided a phase difference of 180 degrees between the microwaves supplied to the microwave feeding points 61*a* and 61*c*, and 62*a* and 62*c*, as will be described later, the two microwave electric powers supplied to the respective radiation portions 61 and 62 are synthesized, thereby causing radiations of microwaves as linearly polarized waves therefrom.

With reference to FIG. 10, there will be described the mechanism for synthesizing electric power and for generating such linearly polarized waves in the fifth aspect of radiations.

Assuming that, at a time t=t0, the microwaves fed to the first microwave feeding points 61*a* and 62*a* have a phase (absolute phase) of 90 degrees, at this time, the phase (absolute phase) of the microwaves fed to the third microwave feeding points 61*c* and 62*c* is delayed by 180 degrees from the feeding phase for the first microwave feeding points 61*a* and 62*a* and, therefore, is −90 degrees (270 degrees).

Accordingly, at the time t=t0, the microwaves from the first microwave feeding point 61*a* in the first radiation portion 61 and from the first microwave feeding point 62*a* in the second radiation portion 62 induce microwave electric fields in directions opposite from each other (microwave electric fields designated by arrows 61A and 62A in FIG. 10).

On the other hand, at the time t=t0, the microwaves fed to the third microwave feeding points 61*c* and 62*c* induce microwave electric fields in the same directions as those of the microwave electric fields 61A and 62A induced by the microwaves fed to the first microwave feeding points 61*a* and 62*a*, as designated by arrows 61C and 62C in FIG. 10, since the microwaves fed to the third microwave feeding points 61*c* and 62*c* have a phase delayed by 180 degrees from that of the microwaves to the first microwave feeding points 61*a* and 62*a*. As a result thereof, the two microwave electric fields induced by the microwaves fed to the first microwave feeding points 61*a* and 62*a* and the third microwave feeding points 61*c* and 62*c* are synthesized (61(A+C)), 62(A+C))

In FIG. 10, the microwave electric field 61(A+C) indicates the two microwave electric fields synthesized with each other, namely there is held the following: the microwave electric field 61(A+C)=(61A+61C). Similarly, the microwave electric field 62(A+C) indicates the two microwave electric fields synthesized with each other, namely there is held the following: the microwave electric field 62(A+C)=(62A+62C).

At a time t=t0+T/4 (T indicates the period), the microwaves fed to the first microwave feeding points 61*a* and 62*a* have a phase of 180 degrees, and the microwaves fed to the third microwave feeding points 61*c* and 62*c* have a phase of 0 degree. Therefore, at the time t=t0+T/4, the microwave electric fields have a magnitude of zero.

At a time t=t0+T/2, the microwaves fed to the first microwave feeding points 61*a* and 62*a* have a phase of 270 degrees, and the microwaves fed to the third microwave feeding points 61*c* and 62*c* have a phase of 90 degrees. This induces, at the time t=t0+T/2, microwave electric fields (microwave electric fields designated by thick arrows 61(A+C) and 62(A+C) in FIG. 10) in the opposite directions from those of the microwave electric fields at the time t=t0, and their electric power is synthesized.

At a time t=t0+3T/4, the microwaves fed to the first microwave feeding points 61*a* and 62*a* have a phase of 360 degrees (0 degree), and the microwaves fed to the third microwave feeding points 61*c* and 62*c* have a phase of 180 degrees. Therefore, at the time t=t0+3T/4, the microwave electric fields have a magnitude of zero, similarly to at the time t=t0+T/4.

At the time t=t0+4T/4, similarly to at the time t=t0, the microwaves fed to the first microwave feeding points 61*a* and 62*a* and the third microwave feeding points 61*c* and 62*c* induce two microwave electric fields synthesized with each other (synthesized microwave electric fields designated by 61(A+C) and 62(A+C) in FIG. 10).

When the movements of the microwave electric fields which change with time as described above are overlaid on the surfaces of the radiation portions, as illustrated at a lowermost portion in FIG. 10, the first radiation portion 61 and the second radiation portion 62 generate linearly polarized waves, in a state where the two microwave electric powers supplied thereto are synthesized.

Further, the respective linearly polarized waves generated from the first radiation portion 61 and the second radiation portion 62 are such that the microwave electric fields therefrom are in directions opposite from each other at the same time point.

[Description of Second Aspect of Radiations]

Figure 11:
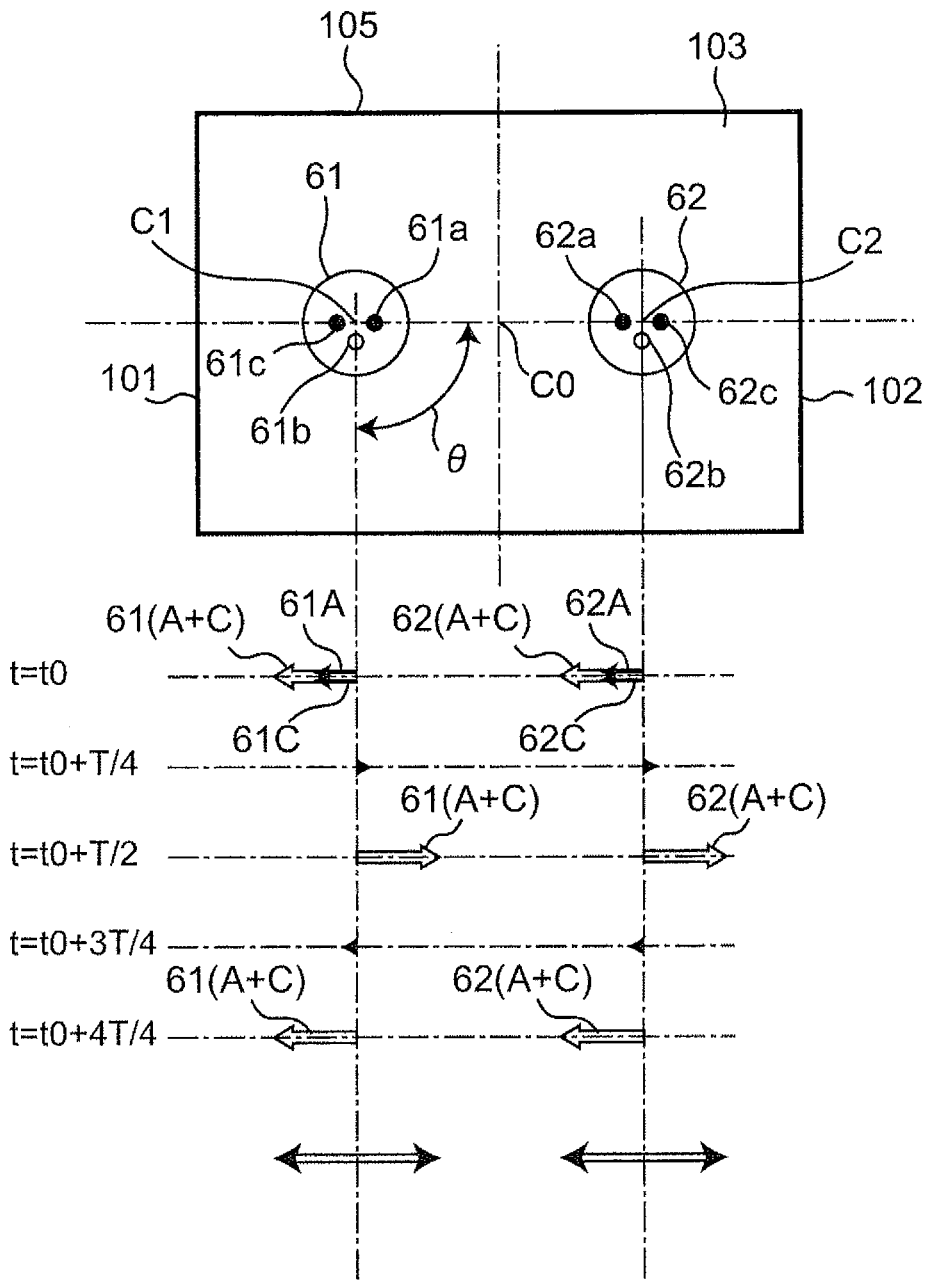
FIG. 11 is a view illustrating a fifth aspect of radiations from the radiation portions in the microwave heating device according to the second embodiment.

FIG. 11 is a view illustrating a fifth aspect of radiations from the radiation portions 61 and 62 in the microwave heating device according to the second embodiment.

In the fifth aspect of radiations illustrated in FIG. 11, the third microwave feeding point 61*c* in the first radiation portion 61 and the first microwave feeding point 62*a* in the second radiation portion 62 are fed with electricity at a feeding phase delayed by 180 degrees from the feeding phase for the first microwave feeding point 61*a* in the first radiation portion 61, while the feeding phase for the third microwave feeding point 62*c* in the second radiation portion 62 is set to be the same as the feeding phase for first microwave feeding point 61*a* in the first radiation portion 61. Further, electricity fed to the second microwave feeding points 61*b* and 62*b* is cut off. In FIG. 11, the microwave feeding points which are fed with electricity (61*a*, 61*c*, 62*a*, 62*c*) are designated by black circle marks, while the microwave feeding points which are not fed with electricity (61*b*, 62*b*) are designated by white circle marks.

Here, the phase delay of 180 degrees is expressed as a characteristic value at the center frequency (for example, 2450 MHz) in the frequency range used in the microwave heating device.

By placing the microwave feeding points 61*a*, 61*b*, 61*c*, 62*a*, 62*b* and 62*c* in the respective radiation portions 61 and 62 as described above, and by employing the fifth aspect of radiations where the certain microwave feeding points 61*a*, 61*c*, 62*a* and 62*c* are supplied with microwaves, and there is provided a phase difference of 180 degrees between the microwaves supplied to the microwave feeding points 61*a* and 61*c* and 62*a* and 62*c*, the two microwave electric powers supplied to the respective radiation portions 61 and 62 are synthesized, thereby causing radiations of microwaves as linearly polarized waves therefrom.

With reference to FIG. 11, there will be described the mechanism for synthesizing electric power and for generating such linearly polarized waves in the fifth aspect of radiations.

Assuming that, at a time t=t0, the microwaves fed to the first microwave feeding point 61*a* in the first radiation portion 61 have a phase (absolute phase) of 90 degrees, the phase (absolute phase) of the microwaves fed to the third microwave feeding point 61*c* in the first radiation portion 61 and the first microwave feeding point 62*a* in the second radiation portion 62 is delayed by 180 degrees from the feeding phase for the first microwave feeding point 61*a* and, therefore, is −90 degrees (270 degrees). Further, the microwaves fed to the microwave feeding point 62*c* in the second radiation portion 62 have a phase of 90 degrees.

Accordingly, at the time t=t0, the microwaves from the microwave feeding point 61*a* in the first radiation portion 61 and the first microwave feeding point 62*a* in the second radiation portion 62 induce microwave electric fields in the same direction (microwave electric fields designated by arrows 61A and 62A in FIG. 11).

On the other hand, at the time t=t0, the microwaves fed to the third microwave feeding points 61*c* and 62*c* induce microwave electric fields in the same directions as those of the microwave electric fields 61A and 62A induced by the microwaves fed to the first microwave feeding points 61*a* and 62*a*, as designated by arrows 61C and 62C in FIG. 11, since the microwaves fed to the third microwave feeding points 61*c* and 62*c* have a phase delayed by 180 degrees from that of the microwaves to the first microwave feeding points 61*a* and 62*a*. As a result thereof, the two microwave electric fields induced by the microwaves fed to the first microwave feeding points 61*a* and 62*a* and the third microwave feeding points 61*c* and 62*c* are synthesized (61(A+C)), 62(A+C)).

In FIG. 11, the microwave electric field 61(A+C) indicates the two microwave electric fields synthesized with each other, namely there is held the following: the microwave electric field 61(A+C)=(61A+61C). Similarly, the microwave electric field 62(A+C) indicates the two microwave electric fields synthesized with each other, namely there is held the following: the microwave electric field 62(A+C)=(62A+62C).

At a time t=t0+T/4 (T indicates the period), the microwaves fed to the first microwave feeding point 61*a* in the first radiation portion 61 and the third microwave feeding point 62*c* in the second radiation portion 62 have a phase of 180 degrees, and the microwaves fed to the third microwave feeding point 61*c* in the first radiation portion 61 and the first microwave feeding point 62*a* in the second radiation portion 62 have a phase of 0 degrees. Therefore, at the time t=t0+T/4, the microwave electric fields have a magnitude of zero.

At a time t=t0+T/2, the microwaves fed to the first microwave feeding point 61*a* in the first radiation portion 61 and the third microwave feeding point 62*c* in the second radiation portion 62 have a phase of 270 degrees, and the microwaves fed to the third microwave feeding point 61*c* in the first radiation portion 61 and the first microwave feeding point 62*a* in the second radiation portion 62 have a phase of 90 degrees. This induces, at the time t=t0+T/2, microwave electric fields (microwave electric fields designated by arrows 61(A+C) and 62(A+C) in FIG. 11) in the opposite directions from those of the microwave electric fields at the time t=t0, thereby synthesizing their electric powers.

At a time t=t0+3T/4, the microwaves fed to the first microwave feeding point 61*a* in the first radiation portion 61 and the third microwave feeding point 62*c* in the second radiation portion 62 have a phase of 360 degrees (0 degree), and the microwaves fed to the third microwave feeding point 61*c* in the first radiation portion 61 and the first microwave feeding point 62*a* in the second radiation portion 62 have a phase of 180 degrees. Therefore, similarly to at the time t=t0+T/4, the microwave electric fields have a magnitude of zero.

At a time t=t0+4T/4, similarly to at the time t=t0, the microwaves fed to the first microwave feeding points 61*a* and 62*a* and the third microwave feeding points 61*c* and 62*c* induce two microwave electric fields synthesized with each other (synthesized microwave electric fields designated by arrows 61(A+C) and 62(A+C) in FIG. 11).

When the movements of the microwave electric fields which change with time as described above are overlaid on the surfaces of the radiation portions, as illustrated at a lowermost portion in FIG. 11, the first radiation portion 61 and the second radiation portion 62 induce linearly polarized waves in a state where the two microwave electric powers fed thereto are synthesized with each other.

Further, the respective linearly polarized waves generated from the first radiation portion 61 and the second radiation portion 62 are such that the microwave electric fields therefrom are in the same direction, at the same time point.

The microwave heating device according to the second embodiment described above is structured to be capable of controlling in such a way as to feed no microwave to at least a single microwave feeding point, out of the microwave feeding points 61*a*, 61*b*, 61*c*, 62*a*, 62*b* and 62*c* in each of the radiation portions 61 and 62. With the microwave heating device having the aforementioned structure according to the second embodiment, it is possible to select radiations of circularly polarized waves or radiations of vertically polarized waves from one of the radiation portions (61 or 62), thereby enabling heating to-be-heated objects in desired states, according to the heating condition and the heating state.

Further, the two microwave feeding points (61*a*, 61*c* or 62*a*, 62*c*) in each of the radiation portions (61 or 62) are placed such that the line connecting these microwave feeding points to each other passes through the center point (C1 or C2) of the radiation portion (61 or 62) and, also, the phase difference between the microwaves fed to the respective microwave feeding points is set to 180 degrees, at the center frequency within the used microwave frequency range. As described above, by placing the microwave feeding points at predetermined positions in the radiation portions, and by supplying, thereto, microwaves having a predetermined phase difference therebetween, it is possible to synthesize the two microwave electric powers supplied to the microwave feeding points with each other, thereby causing the respective radiation portions to radiate vertically polarized waves.

[Heating Operations]

There will be described operations for heating a to-be-heated object with the microwave heating device having the aforementioned structure according to the second embodiment.

The microwave heating device according to the second embodiment has a structure which is different from that of the microwave heating device according to the aforementioned first embodiment, in that it is structured to be capable of control for supplying or stopping microwaves to the respective microwave feeding points 61*a*, 61*b*, 61*c*, 62*a*, 62*b* and 62*c* in the respective radiation portions 61 and 62.

Accordingly, with the microwave heating device according to the second embodiment, in a stage prior to the start of heating of the to-be-heated object, it is possible to select microwave feeding points in the radiation portion 61 and 62 which are to be supplied with microwaves, before the start of heating, according to heating conditions set by the user. When a selection of microwave feeding points has been made, a frequency selection operation for selecting an optimum oscillation frequency for the to-be-heated object is performed, under the heating conditions using the selected microwave feeding points, to determine an oscillation frequency for use in heating. The content of the control for this frequency selection operation conforms to the outline described in the aforementioned first embodiment and, therefore, will not be described in the second embodiment.

Further, if control for changing over among the microwave feeding points in the microwave oscillation portion 50*a* is performed during the progress of heating, this changes the optimum oscillation frequency. Accordingly, every time control for changing over thereamong has been performed, a frequency selection operation for selecting an optimum oscillation frequency is performed under this condition, thereby determining an optimum oscillation frequency for heating.

Next, there will be described a series of operations for processing for heating the to-be-heated object within the heating chamber 100.

At first, by opening and closing the openable door, the to-be-heated object is housed within the heating chamber 100, and the heating chamber 100 is closed and, then, the user inputs conditions for heating this to-be-heated object to an operation portion (not illustrated) and, then, pushes a heating start key. Since the heating start key has been pushed, a heating start signal is created and is inputted to a control portion 63. The control portion 63, to which the heating start signal has been inputted, outputs a control signal to the microwave generating portion 50, which causes the microwave generating portion 50 to start operating. At this time, the control portion 63 drives and controls the microwave generating portion 50, based on various types of information, such as the heating conditions Q for the to-be-heated object. Further, the control portion 63 operates a driving power supply (not illustrated) provided in the microwave heating device for supplying electric power to the microwave oscillation portion 50*a*, the initial-stage amplification portions 55*a* to 55*f*, and the main amplification portions 56*a* to 56*f*.

The control portion 63 controls the phase variable portions 52*a* to 52*f* and the phase-locked loops 53*a* to 53*f*, which are constituents of the microwave oscillation portion 50*a*, based on the inputted heating conditions, for making a selection of microwave feeding points 61*a*, 61*b*, 61*c*, 62*a*, 62*b*, 62*c* in the radiation portions 61 and 62 which are to be supplied with microwaves at the time of the start of heating, and for determining the phase differences among the selected microwave feeding points.

Thereafter, as processing before the start of heating operations, a frequency selection operation for selecting an oscillation frequency for use in heating is performed. The content of the control for this frequency selection operation conforms to the outline described in the aforementioned first embodiment and, therefore, will not be described in the second embodiment.

In the microwave heating device according to the second embodiment, after determining the oscillation frequency for heating, the control portion 63 controls the phase-locked loops 53*a* to 53*f* in the oscillation portion 50*a* for oscillating them at the determined oscillation frequency. Thereafter, the control portion 63 operates the initial-stage amplification portions 55*a* to 55*f* and the main amplification portions 56*a* to 56*f* for causing the microwave generating portion 50 to supply microwaves at desired phases to the desired microwave feeding points and, also, for controlling the respective radiation portions 61 and 62 to radiate, to the inside of the heating chamber 100, microwaves in a desired aspect of radiations (circularly polarized waves or linearly polarized waves).

At this time, each microwave feeding point is supplied with microwave electric power having an electric power value in the range of 200 W to 300 W.

When microwaves are radiated from the radiation portions 61 and 62 in the fourth aspect of radiations (see FIG. 10) according to the second embodiment, for example, the microwaves strongly propagate in the direction in which the left and right side wall surfaces 101 and 102 are faced to each other and, at a certain time point (t=t0+T/2 in FIG. 10), the microwaves radiated from both the radiation portions 61 and 62 come into collision with each other at the center of the heating chamber 100. As a result thereof, the to-be-heated object placed substantially at the center of the heating chamber 100 is strongly heated at its substantially-center portion.

When microwaves are radiated from the radiation portions 61 and 62 in the fifth aspect of radiations (see FIG. 11) according to the second embodiment, for example, the microwaves strongly propagate in the direction in which the left and right side wall surfaces 101 and 102 are faced to each other and, at a certain time point (t=t0 in FIG. 11), the microwaves radiated from the two radiation portions 61 and 62 are aligned with the direction toward the left side wall surface 101 and, at another time point (t=t0+T/2 in FIG. 11), the microwaves radiated from the two radiation portions 61 and 62 are aligned with the direction toward the right side wall surface 102. As a result thereof, it is possible to effectively heat to-be-heated objects which are placed in left and right sides of the heating chamber 100 with an approximate center thereof sandwiched therebetween.

When detection signals from the detection means for detecting the temperature of the surface of the to-be-heated object, and/or conditions of heating-time information and the like, out of the heating conditions which have been set, satisfy the pre-set conditions, and it is determined that it is necessary to make a re-selection of an aspect of radiations from the radiation portions 61 and 62 or it is necessary to make re-selections of microwave feeding points and phase differences thereamong, for this re-selection, it is possible to make a re-selection of a frequency, and it is possible to continue the heating operation for the to-be-heated object with the re-selected frequency. During the heating operation, if it is determined that a heating condition, such as the finishing temperature or the total heating time, has been satisfied, this heating operation is completed.

Further, while there has been described an example where the microwave heating device according to the second embodiment employs the two radiation portions 61 and 62, the present invention can be also applied to a microwave heating device having a structure provided with two or more radiation portions according to specifications of the microwave heating device, and the like.

Further, in the microwave heating device according to the second embodiment, the plural radiation portions can be placed on the same wall surface in the heating chamber, which can concentrate the radiation portions on the single wall surface, thereby making it easier to place a member for covering the radiation portions for protecting these radiation portions.

Further, the plural radiation portions can be placed within the heating chamber such that the directions of excitations thereof are coincident with the widthwise direction and the depthwise direction of the heating chamber, which enables defining the directions of excitations of the radiation portions in the directions toward the wall surfaces of the heating chamber for clarifying the directions of propagations of microwaves within the heating chamber, thereby enabling phase control among the respective microwave feeding points or among the radiation portions, according to the progress of preferable heating of to-be-heated objects.

Further, it is possible to vary the levels of electricity supplied to the microwave feeding points in the radiation portions according to the ratio between the widthwise size and the depthwise size of the heating chamber, which can facilitate dispersion of microwaves within the heating chamber according to the shape of the heating chamber.

For example, in cases where the heating chamber has a larger width, by supplying larger microwave electric power to the feeding points associated with the excitations in the widthwise direction, it is possible to radiate circularly polarized waves having an elliptical circling shape with a larger size in the widthwise direction of the heating chamber, thereby facilitating dispersion of radio waves within the heating chamber.

According to the second embodiment described above, by selecting microwave feeding points through control of the output of the microwave oscillation portion 50 and by selecting conditions of phase differences among the respective microwave feeding points through control of the phase variable portions, it is possible to facilitate heating of a certain portion of a to-be-heated object, it is possible to heat an entire to-be-heated object in a desired state or it is possible to heat plural to-be-heated objects at the same time.

Further, while, in the second embodiment, there has been exemplified a case where microwaves fed to a single microwave feeding point are cut off in each single radiation portion, it is also possible to make a selection of cutoff of microwaves fed to all the microwave feeding portions in a certain radiation portion. By making such a selection, for example, it is possible to radiate microwaves from only a single radiation portion, thereby selectively heating plural to-be-heated objects placed within the heating chamber.

Further, when the radiation portions are structured to have two or more microwave feeding portions, it is possible to make selections of microwave feeding points therefrom, as microwave feeding points to be supplied with no microwave, in each of the radiation portions, wherein the number of selected microwave feeding portions can be zero at a minimum, while it is also possible to select all the microwave feeding portions at a maximum.

As described above, in the microwave heating device according to the second embodiment, the microwaves supplied to the microwave feeding points are generated by the microwave generating portion constituted by the semiconductor devices. Accordingly, with the microwave heating device according to the second embodiment, it is possible to make the device including the plural radiation portions compact and, further, it is possible to vary the phase differences among the feeding points in the respective radiation portions and the phase differences among the radiation portions, thereby enabling various aspects of radiations from the radiation portions. Accordingly, the microwave heating device according to the second embodiment is capable of facilitating proper heating operations according to the types, the volumes and the shapes of to-be-heated objects, thereby forming a heating device with excellent convenience.

Third Embodiment

Next, there will be described a microwave heating device according to a third embodiment of the present invention, with reference to the accompanying FIG. 12. The microwave heating device according to the third embodiment is different from the microwave heating device according to the aforementioned first embodiment, in the positions at which radiation portions are placed within the heating chamber, but is the same as the microwave heating device according to the first embodiment in terms of the other points. Accordingly, in the description of the third embodiment, components having the same functions and structures as those of the aforementioned first embodiment will be designated by the same reference characters, and descriptions thereof will be omitted by substituting the description in the first embodiment therefor.

Figure 12:
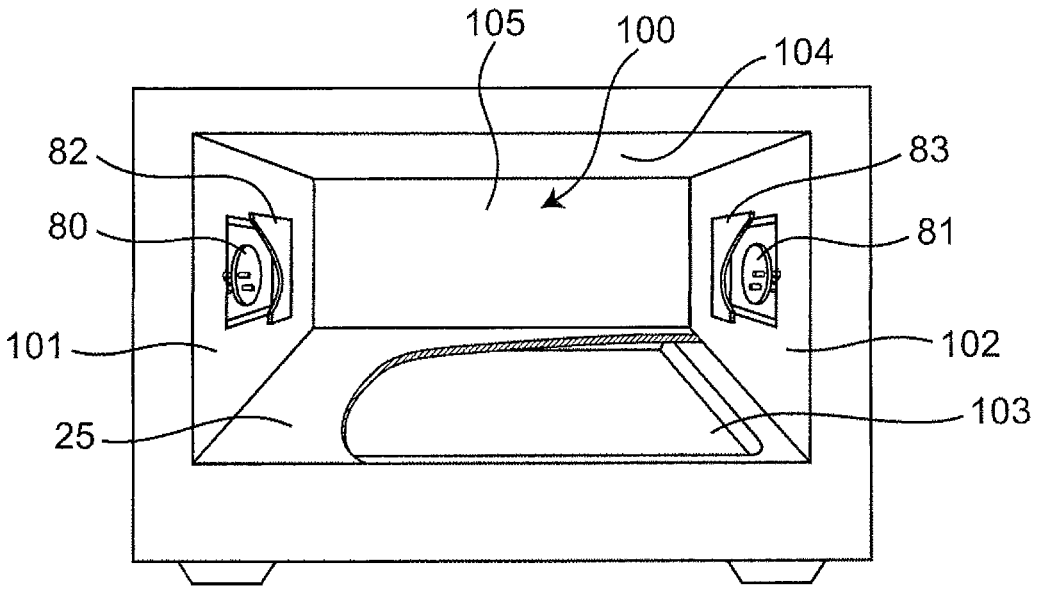
FIG. 12 is a perspective view illustrating the inside of a heating chamber in a microwave oven as a microwave heating device according to a third embodiment of the present invention.

FIG. 12 is a perspective view illustrating the inside of a heating chamber 100 in a microwave oven as a microwave heating device according to the third embodiment. In FIG. 12, the inside of the heating chamber 100 is cutout at a portion (a placement plate 25) thereof, and an openable door for opening and closing the heating chamber 100 is not illustrated.

As illustrated in FIG. 12, the microwave heating device according to the third embodiment includes radiation portions 80 and 81 which are placed at respective approximate centers of a left wall surface 101 and a right wall surface 102 faced to each other, out of the wall surfaces forming the heating chamber 100 having a substantially rectangular parallelepiped structure for housing a to-be-heated object therein.

Each of the radiation portions 80 and 81 has plural (two, in the third embodiment) microwave feeding points, and there is provided a microwave generating portion 10 having the same structure as that of the microwave generating portion 10 described with reference to FIG. 2 in the aforementioned first embodiment, wherein plural outputs of the microwave generating portion 10 are directed to the respective microwave feeding points.

The shape of the radiation portions 80 and 81, and the placement and the structure of the microwave feeding points in each of the radiation portions 80 and 81 are the same as those in the first embodiment. In the microwave heating device according to the third embodiment, the two microwave feeding points in each of the radiation portions 80 and 81 are placed symmetrically with respect to a center plane in the leftward and rightward direction of the heating chamber 100.

In the microwave heating device according to the third embodiment, since the radiation portions are placed opposing to the opposing wall surfaces of the heating chamber, it is possible to certainly cause microwaves radiated from the respective radiation portions to come into collision with each other in the space. With the microwave heating device according to the third embodiment, it is possible to change the microwave distribution more certainly, by changing the phase difference between the radiation portions oppositely placed to each other.

Further, in the microwave heating device according to the third embodiment, in order to protect the radiation portions 80 and 81, there are provided covers 82 and 83 made of a low dielectric loss material for these respective radiation portions.

Further, in the microwave heating device according to the third embodiment, a single radiation portion 80 or 81 can be provided with three or more microwave feeding points. Further, the respective radiation portions can be provided with different numbers of microwave feeding points.

Fourth Embodiment

Next, there will be described a microwave heating device according to a fourth embodiment of the present invention, with reference to the accompanying FIGS. 13 and 14. The microwave heating device according to the fourth embodiment is different from the microwave heating device according to the aforementioned first embodiment, in that radiation portions have four microwave feeding points, but is the same as the microwave heating device according to the first embodiment in terms of the other points. Accordingly, in the description of the third embodiment, components having the same functions and structures as those of the aforementioned first embodiment will be designated by the same reference characters, and descriptions thereof will be omitted by substituting the description in the first embodiment therefor.

Figure 13:
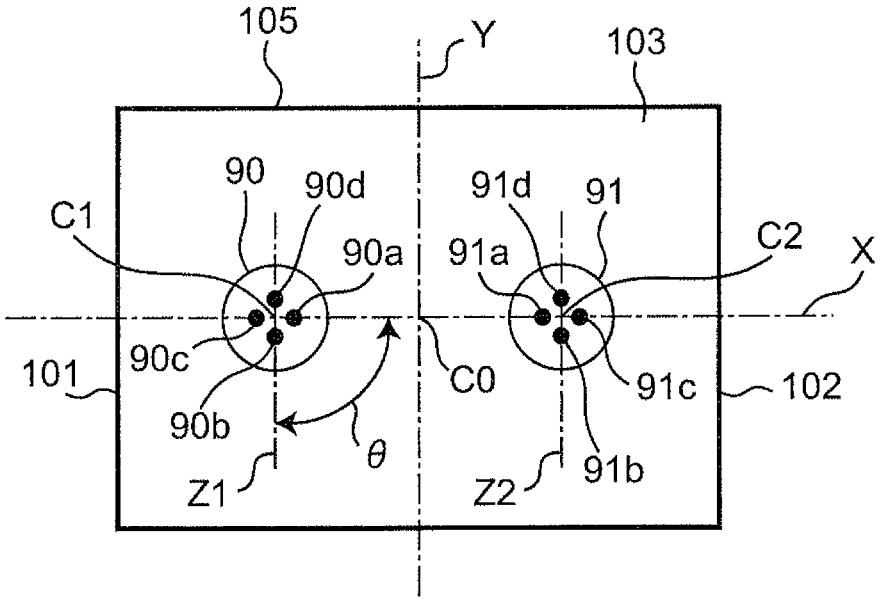
FIG. 13 is a plan view illustrating radiation portions which are placed on a bottom wall surface in a microwave heating device according to a fourth embodiment of the present invention.

FIG. 13 is a plan view illustrating the radiation portions placed on the bottom wall surface in the microwave heating device according to the fourth embodiment. In the microwave heating device according to the fourth embodiment, each single microwave radiation portion is provided with four microwave feeding points.

In the microwave heating device according to the fourth embodiment, the two radiation portions (a first radiation portion 90 and a second radiation portion 91) are placed at positions symmetrical with respect to a center line in the forward and rearward direction of the device (a line designated by a reference character Y in FIG. 13), which passes through an approximate-center point (C0) of the bottom wall surface 103.

The first radiation portion 90 has four microwave feeding portions 90*a*, 90*b*, 90*c* and 90*d*, wherein respective outputs of the microwave generating portion are directed to the microwave feeding points 90*a*, 90*b*, 90*c* and 90*d*. Similarly, the second radiation portion 91 has four microwave feeding portions 91*a*, 91*b*, 91*c* and 91*d*, wherein the respective outputs of the microwave generating portion are directed to the microwave feeding points 91*a*, 91*b*, 91*c* and 91*d*.

The microwave generating portion in the microwave heating device according to the fourth embodiment basically has the same structure as that of the microwave generating portion 10 according to the first embodiment, wherein a reference-signal oscillator in the microwave oscillation portion outputs eight reference signals, and the respective reference signals are inputted to phase variable portions. In the microwave oscillation portion, the phase variable portions and phase-locked loops are adapted to form and output microwave signals satisfying conditions. The microwave signals from the microwave oscillation portion are amplified by amplification portions to form optimum microwave electric power, which is supplied to the respective microwave feeding points. As described above, in the microwave generating portion, there are formed the eight microwave amplification paths, and there are provided eight output portions for supplying optimum microwave electric power to the eight microwave feeding points.

As illustrated in FIG. 13, the first radiation portion 90 is provided with the four microwave feeding points 90*a*, 90*b*, 90*c* and 90*d* which are placed at equal distances from the center C1 and with an angular pitch of 90 degrees. Similarly, the second radiation portion 91 is provided with the four microwave feeding points 91*a*, 91*b*, 91*c* and 91*d* which are placed at equal distances from the center C2 and with an angular pitch of 90 degrees.

The feeding phases for the first microwave feeding point 90*a* and the third microwave feeding point 90*c* are made to be equal to each other, wherein the first microwave feeding point 90*a* and the third microwave feeding point 90*c* are placed on the center line in the leftward and rightward direction of the device (the line designated by a reference character X in FIG. 13), which passes through the center C1 of the first radiation portion 90. Further, the feeding phases for the second microwave feeding point 90*b* and the fourth microwave feeding point 90*d*, which are placed orthogonally to the first microwave feeding point 90*a* and the third microwave feeding point 90*c*, are set, such that the second microwave feeding point 90*b* and the fourth microwave feeding point 90*d* are fed with electricity at a phase delayed by 90 degrees from the feeding phase for the first microwave feeding point 90*a* and the third microwave feeding point 90*c*.

Here, the phase delay of 90 degrees is expressed as a characteristic value at the center frequency (for example, 2450 MHz) in the frequency range used in the microwave heating device.

As described above, in the microwave heating device according to the fourth embodiment, the microwave feeding points 90*a*, 90*b*, 90*c*, 90*d*, 91*a*, 91*b*, 91*c* and 91*d* are placed in the respective radiation portions 90 and 91, and the microwaves supplied to the respective microwave feeding points 90*a*, 90*b*, 90*c*, 90*d*, 91*a*, 91*b*, 91*c* and 91*d* are controlled in terms of their phases, which enables synthesizing the two microwave electric powers supplied through the first microwave feeding points 90*a*, 91*a* and the third microwave feeding points 90*c*, 91*c*, and the second microwave feeding points 90*b*, 91*b* and the fourth microwave feeding points 90*d*, 91*d*, which are placed on straight lines in the respective radiation portions 90 and 91 with the centers C1 and C2 sandwiched therebetween.

Further, in the microwave heating device according to the fourth embodiment, by employing a sixth aspect of radiations where the microwaves supplied to the second microwave feeding points 90*b* and 91*b* and the fourth microwave feeding points 90*d* and 91*d* are delayed in phase by 90 degrees from those for the first microwave feeding points 90*a* and 91*a* and the third microwave feeding points 90*c* and 91*c*, as will be described later, the respective radiation portions 90 and 91 are adapted to radiate microwaves forming circularly polarized waves having larger microwave electric power resulted from the synthesis of the two microwave electric powers.

[Description of Sixth Aspect of Radiations]

Figure 14:
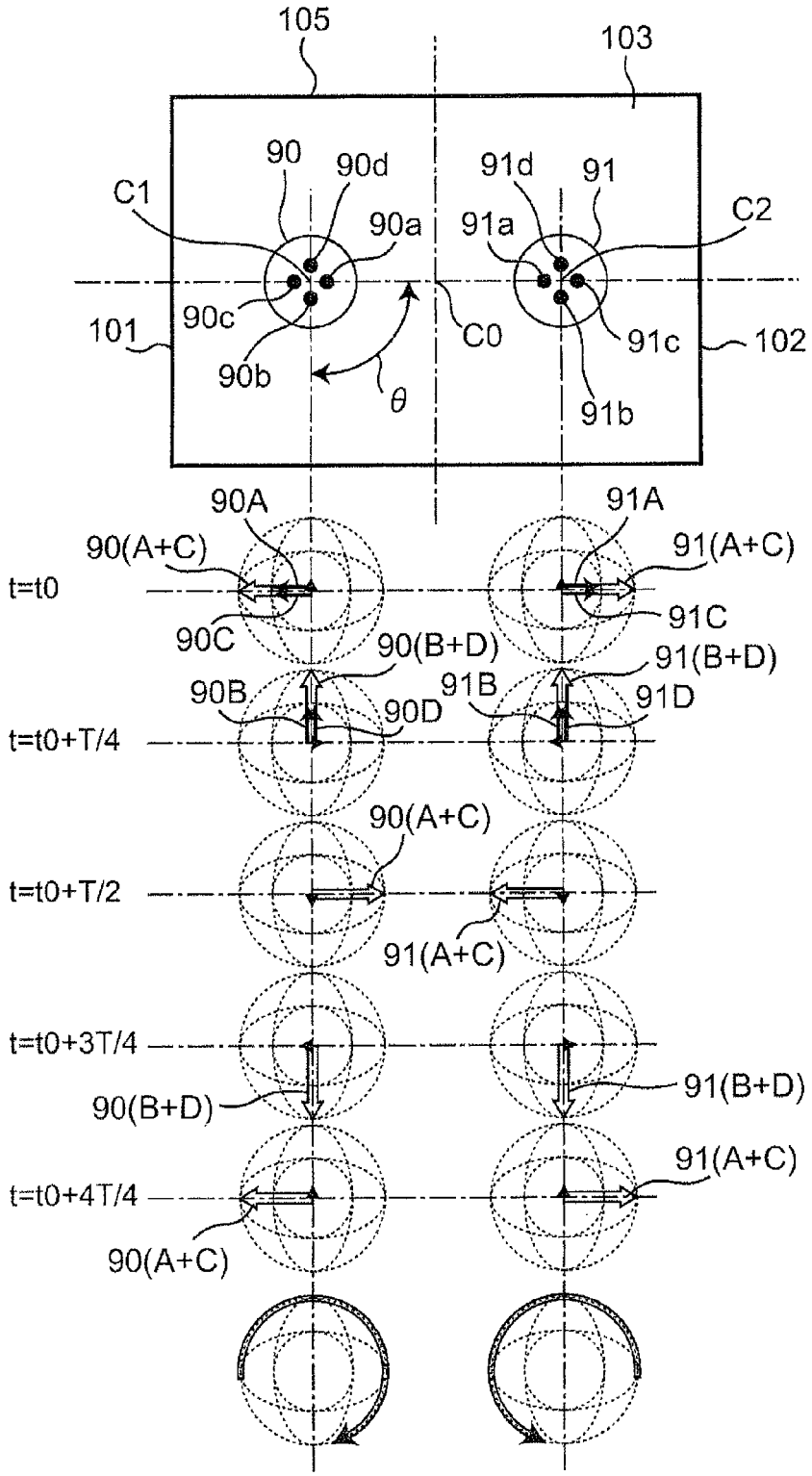
FIG. 14 is a view illustrating a sixth aspect of radiations from the radiation portions in the microwave heating device according to the fourth embodiment.

With reference to FIG. 14, there will be described the mechanism for synthesizing electric power and for generating such circularly polarized waves in the sixth aspect of radiations. FIG. 14 is a view illustrating the sixth aspect of radiations from the radiation portions 90 and 91 in the microwave heating device according to the fourth embodiment.

Assuming that, at a time t=t0, the phase (the absolute phase) of electricity fed to the microwave feeding points 90*a*, 90*c* and 91*a* and 91*c* is 90 degrees, the phase (the absolute phase) of the microwave signals supplied to the microwave feeding points 90*b*, 90*d* and 91*b* and 91*d* is delayed by 90 degrees from the feeding phase for the microwave feeding points 90*a*, 90*c* and 91*a*, 91*c* and, therefore, is 0 degree.

Accordingly, at the time t=t0, the microwaves from the microwave feeding points 90*a*, 90*c* and 91*a*, 91*c* induce microwave electric fields in directions opposite from each other (microwave electric fields designated by thick arrows 90(A+C) and 91(A+C) in FIG. 14).

Further, in FIG. 14, the arrow 90(A+C) designating the microwave electric field indicates the value of the sum of the microwave electric field from the microwave feeding point 90*a*, which is designated by an arrow 90A, and the microwave electric field from the microwave feeding point 90*c*, which is designated by an arrow 90C. Further, in FIG. 14, arrows 91(A+C), 90(B+D) and 91(B+D) indicating other microwave electric fields indicate the values of the sums of the respective microwave electric fields, similarly to the aforementioned arrow 90(A+C).

At a time t=t0+T/4 (T indicates the period), the microwave signals supplied to the microwave feeding points 90*a*, 90*c* and 91*a*, 91*c* have a phase of 180 degrees, while the microwave signals supplied to the microwave feeding points 90*b*, 90*d* and 91*b*, 91*d* have a phase of 90 degrees. This induces, at the time t=t0+T/4, microwave electric fields (microwave electric fields designated by thick arrows 90(B+D) and 91(B+D) in FIG. 14).

At a time t=t0+T/2, the microwave signals supplied to the microwave feeding points 90*a*, 90*c* and 91*a*, 91*c* have a phase of 270 degrees, while the microwave signals supplied to the microwave feeding points 90*b*, 90*d* and 91*b*, 91*d* have a phase of 180 degrees. This induces, at the time t=t0+T/2, microwave electric fields (microwave electric fields designated by thick arrows 90(A+C) and 91(A+C) in FIG. 14) in the opposite directions from those of the microwave electric fields at the time t=t0.

At a time t=t0+3T/4, the microwave signals supplied to the microwave feeding points 90*a*, 90*c* and 91*a*, 91*c* have a phase of 360 degrees (0 degree), while the microwave signals supplied to the microwave feeding points 90*b*, 90*d* and 91*b*, 91*d* have a phase of 270 degrees. This induces, at the time t=t0+3T/4, microwave electric fields (microwave electric fields designated by thick arrows 90(B+C) and 91(B+D) in FIG. 14) in the opposite directions from those of the microwave electric fields represented at the time t=t0+T/4.

At a time t=t0+4T/4, similarly to at the time t=t0, microwave electric fields designated by thick arrows 90(A+C) and 91(A+C) in FIG. 14 are induced.

When the movements of the microwave electric fields which change with time as described above are overlaid on the surfaces of the radiation portions, as illustrated at a lowermost portion in FIG. 14, the first radiation portion 90 generates right-hand circularly polarized waves, while the second radiation portion 91 generates left-hand circularly polarized waves.

Regarding the magnitude of the electric field vector of the circularly polarized waves (scalar quantity), since the two microwave feeding points are synthesized, the circularly polarized waves generated therefrom have a magnitude which is about twice that in the first aspect of radiations according to the aforementioned first embodiment illustrated in FIG. 4.

As described in the aforementioned respective embodiments, each single radiation portion is provided with plural microwave feeding points, and the phase differences among the microwave feeding points can be controlled, which enables the radiation portions to form radiation distributions having circular shapes or elliptical shapes having radii with various sizes. With the microwave heating device according to the present invention, it is possible to utilize such various aspects of radiations for variably controlling the microwave distribution within the heating chamber in various aspects, which enables easily and certainly realizing uniform heating of a to-be-heated object housed in the heating chamber or concentrated heating for partially and concentratively heating the to-be-heated object, thereby enabling heating the to-be-heated object in a desired state.

With the microwave heating device according to the present invention, it is possible to enable the radiation portions to have aspects of radiations for forming both linearly polarized waves and circularly polarized waves, and, further, it is possible to enable the radiation portions to have an electric-power synthesizing function, which enables certainly heating to-be-heated objects with various shapes, types and volumes in desired states.

INDUSTRIAL APPLICABILITY

The microwave heating device according to the present invention can be also applied to heating devices which utilize induction heating as represented by microwave ovens, garbage disposers, microwave generators in plasma generators as semiconductor fabrication apparatuses or other applications.

The invention claimed is:

1. A microwave heating device comprising:

a microwave oscillation portion including plural phase-locked loops connected to a single reference-signal oscillator and having plural outputs;

plural amplification portions for amplifying the respective outputs from the microwave oscillation portion;

plural radiation portions which are adapted to be supplied with outputs from the amplification portions and to radiate microwaves to a heating chamber; and a control portion for controlling the microwave oscillation portion, wherein each of the radiation portions has plural microwave feeding points, the respective outputs from the amplification portions are supplied to the respective microwave feeding points, the radiation portions are antennas having a substantially-disc shape, the radiation portions are placed on the same wall surface of the heating chamber, wherein the radiation portions are not placed on the rest of wall surfaces of the heating chamber, the radiation portions and the microwave feeding points in the radiation portions placed on the same wall surface of the heating chamber are placed symmetrically with respect to a line passing through an approximate center of the wall surface;

one microwave feeding point in the respective radiation portions is placed on a line connecting a respective center points of the respective radiation portions to each other, and another microwave feeding point of the respective radiation portions is placed on a respective lines which pass through the center points and are orthogonal to the line connecting the respective center points to each other.

2. The microwave heating device according to claim 1, wherein the microwave oscillation portion includes a phase variable portion for changing, in phase, an oscillating signal outputted from the reference-signal oscillator, whereby microwaves supplied to the plural microwave feeding points in each of the radiation portions are set to have phases having a predetermined phase difference therebetween.

3. The microwave heating device according to claim 2, wherein the at least two microwave feeding points in each of the radiation portions are adapted such that lines connecting the respective microwave feeding points to a center point of this radiation portion form an intersection angle of 90 degrees, and microwaves fed to the respective microwave feeding points are made to have a phase difference of 90 degrees, therebetween, at a center frequency within a used microwave frequency range.

4. The microwave heating device according to claim 2, wherein the at least two microwave feeding points in each of the radiation portions are adapted such that lines connecting the respective microwave feeding points to a center point of this radiation portion form an intersection angle of 90 degrees, and at a center frequency within a used microwave frequency range, with respect to the phase of microwaves fed to one of the microwave feeding points, which is defined as a reference, the phase of microwaves fed to the other microwave feeding point is changed over between 90 degrees and −90 degrees.

5. The microwave heating device according to claim 2, wherein the at least two microwave feeding points in each of the radiation portions are placed such that a line connecting the respective microwave feeding points in this radiation portion to each other passes through a center point of this radiation portion, and microwaves fed to the at least two microwave feeding points are made to have a phase difference of 180 degrees, therebetween, at a center frequency within a used microwave frequency range.

6. The microwave heating device according to claim 1, wherein the microwave oscillation portion includes a phase variable portion for changing, in phase, an oscillating signal outputted from the reference-signal oscillator, whereby microwaves radiated from at least two radiation portions, out of the radiation portions, are made variable in phase difference therebetween.

7. The microwave heating device according to claim 1, wherein the at least two microwave feeding points in each of the radiation portions are adapted such that lines connecting the respective microwave feeding points to a center point of this radiation portion form an intersection angle of 90 degrees, and microwaves fed to the respective microwave feeding points are made to have a phase difference of 90 degrees, therebetween, at a center frequency within a used microwave frequency range.

8. The microwave heating device according to claim 1, wherein the at least two microwave feeding points in each of the radiation portions are adapted such that lines connecting the respective microwave feeding points to a center point of this radiation portion form an intersection angle of 90 degrees, and at a center frequency within a used microwave frequency range, with respect to the phase of microwaves fed to one of the microwave feeding points, which is defined as a reference, the phase of microwaves fed to the other microwave feeding point is changed over between 90 degrees and −90 degrees.

9. The microwave heating device according to claim 1, wherein the at least two microwave feeding points in each of the radiation portions are placed such that a line connecting the respective microwave feeding points in this radiation portion to each other passes through a center point of this radiation portion, and microwaves fed to the at least two microwave feeding points are made to have a phase difference of 180 degrees, therebetween, at a center frequency within a used microwave frequency range.

10. The microwave heating device according to claim 1, wherein the control portion has a function of controlling the outputs of the microwave oscillation portion and is adapted to perform control for stopping feeding of microwaves to at least a single microwave feeding point out of the plural microwave feeding points in each of the radiation portions.

* * * * *